US008422721B2

(12) United States Patent
Rizzello

(10) Patent No.: US 8,422,721 B2
(45) Date of Patent: Apr. 16, 2013

(54) SOUND REPRODUCTION SYSTEMS AND METHOD FOR ARRANGING TRANSDUCERS THEREIN

(76) Inventor: Frank Rizzello, Floral Park, NY (US)

( * ) Notice: Subject to any disclaimer, the term of this patent is extended or adjusted under 35 U.S.C. 154(b) by 13 days.

(21) Appl. No.: 12/881,398

(22) Filed: Sep. 14, 2010

(65) Prior Publication Data

US 2012/0063628 A1 Mar. 15, 2012

(51) Int. Cl.
*H04R 1/02* (2006.01)

(52) U.S. Cl.
USPC ..... 381/386; 381/182; 381/184; 381/335

(58) Field of Classification Search ..... 381/89, 381/182, 184, 186, 335, 386, 423–424, 157–174
See application file for complete search history.

(56) References Cited

U.S. PATENT DOCUMENTS

| | | | | | |
|---|---|---|---|---|---|
| 1,690,421 | A | * | 11/1928 | Mcore | 181/173 |
| 1,711,697 | A | * | 5/1929 | Sedgwick | 181/173 |
| 1,759,328 | A | * | 5/1930 | Smythe | 181/173 |
| 1,900,111 | A | * | 3/1933 | Hicks | 181/159 |
| 1,965,405 | A | * | 7/1934 | Blattner | 181/144 |
| 2,106,815 | A | * | 2/1938 | Scheldorf | 181/164 |
| 2,531,634 | A | * | 11/1950 | Lawrance | 181/164 |
| 3,645,355 | A | | 2/1972 | Long | |
| 3,824,343 | A | * | 7/1974 | Dahlquist | 381/335 |
| 3,917,024 | A | * | 11/1975 | Kaiser, Jr. | 181/163 |
| 4,031,318 | A | | 6/1977 | Pitre | |
| 4,119,799 | A | | 10/1978 | Merlino | |
| 4,730,694 | A | | 3/1988 | Albarino | |
| 4,885,782 | A | | 12/1989 | Eberbach | |
| 5,164,549 | A | | 11/1992 | Wolf | |
| 5,430,260 | A | | 7/1995 | Koura et al. | |
| 6,583,768 | B1 | * | 6/2003 | Underbrink | 343/893 |
| 6,801,631 | B1 | | 10/2004 | North | |
| 6,842,157 | B2 | * | 1/2005 | Phelan et al. | 343/893 |
| 7,120,263 | B2 | * | 10/2006 | Azima et al. | 381/152 |
| 7,483,545 | B2 | * | 1/2009 | Nagaoka | 381/423 |
| 7,986,805 | B2 | * | 7/2011 | Nagaoka | 381/424 |
| 2004/0066938 | A1 | * | 4/2004 | Heron et al. | 381/59 |
| 2004/0240697 | A1 | | 12/2004 | Keele, Jr. | |
| 2006/0090955 | A1 | * | 5/2006 | Cardas | 181/158 |
| 2008/0085027 | A1 | | 4/2008 | Engebretson et al. | |
| 2008/0212805 | A1 | | 9/2008 | Fincham | |
| 2011/0129113 | A1 | * | 6/2011 | Kumakura et al. | 381/423 |

OTHER PUBLICATIONS

International Search Report and Written Opinion dated Feb. 29, 2012 (in English) in counterpart International Application No. PCT/US2011/051365.

* cited by examiner

*Primary Examiner* — Curtis Kuntz
*Assistant Examiner* — Ryan Robinson
(74) *Attorney, Agent, or Firm* — Holtz, Holtz, Goodman & Chick, P.C.

(57) ABSTRACT

Loudspeaker system including a housing and at least four transducers arranged therein. Each transducer includes a substantially circular diaphragm and the diaphragms are constructed with specific sizes such that the ratio of a diameter of each diaphragm to the diameter of an immediately larger diaphragm is between 1:1 and 1: $Phi^2$(Phi=(1+√5)/2), preferably 1:Phi, and the ratio of the diameter of each diaphragm to an immediately smaller diaphragm, is between 1:1 and 1:(1/Phi), preferably 1:1/Phi. Moreover, the diaphragms are arranged such that centers thereof lie on a spiral, clockwise or counterclockwise, in ascending size order with the center of the smallest diaphragm being closest to the pole of the spiral. A microphone and single-diaphragm loudspeaker in which the diaphragm has a spiral shape are also disclosed.

18 Claims, 15 Drawing Sheets

SOUND REPRODUCTION SYSTEMS AND METHOD FOR ARRANGING TRANSDUCERS THEREIN

FIELD OF THE INVENTION

The present invention relates generally to sound reproduction systems, such as loudspeaker systems, microphones, headphones and hearing aids, and more specifically to high fidelity loudspeaker systems including multiple transducers arranged in relation to one another and in relation to the loudspeaker system in its entirety to provide a full-bodied sound.

BACKGROUND OF THE INVENTION

A common loudspeaker system includes a single diaphragm, moving coil and has a simple construction and is quite dependable. It is a fundamentally correct design as its sound source essentially collapses toward its center as the frequency increases. As such, it is a practical embodiment of the theoretically ideal "point source" transducer, and if well designed, it can exhibit a facsimile of the input signal, albeit over a limited bandwidth of frequencies usually near the middle of its range.

The audible sound spectrum comprising approximately ten octaves (a doubling or halving of frequency) from 20 Hz-20 kHz has proven virtually impossible for any single diaphragm, which is mass-controlled, to replicate accurately. One reason for this is because the requirements for propagating low frequencies (long wavelengths) and high frequencies (short wavelengths) are very different, and therefore mutually exclusive.

In light of the need to replicate or cover the full frequency range more accurately, specially designed transducers have been developed which cover overlapping bands of frequencies. Some of these specially designed transducers are connected to a frequency dividing network or crossover, either passive, electronic or both, which functions to divide the frequencies of the output of an audio amplifier or amplifiers into frequency bands which are directed to the respective transducers constructed to reproduce those bands.

Crossover frequencies are primarily determined by the usable bandwidth of the transducer. For tweeters (high frequency transducers), it is usually determined by the resonant frequency and the crossover point should be one or, more preferably, two octaves above the resonance frequency. The upper limit for woofers (low frequency transducers) is usually determined by the horizontal polar response. As the frequency increases, and the wavelength becomes the same size or smaller than the diameter of the transducer, the diaphragm's acoustic output becomes restricted to progressively narrower solid angles, and begins to become very directional. The most often used criterion for the crossover point of a woofer is the frequency at which the output is six decibels down (−6 db) at forty-five degrees (45°) off axis.

These two-way loudspeaker systems (the "two" ways implying the presence of two transducers such as a woofer and a tweeter) generally exhibit wider dispersion of the higher frequencies, higher power handling, lower modulation distortion, and lower intermodulation distortion, among other attendant benefits.

Among the first attempts at successfully implementing these specialized transducers were two-way coaxial loudspeakers wherein the high frequency transducer (tweeter) was centrally mounted with respect to the larger low frequency transducer (woofer), and hence shared a common axis. These loudspeakers were quite common and they also maintained the point source attribute previously mentioned. In most larger full range systems however (e.g., those manufactured and/or sold by Altec Lancing), this arrangement, owing mainly to a lack of space for a wider range tweeter, lead manufacturers to design and manufacture two-way systems wherein the tweeter was non-coincident with respect to the woofer. The tweeter was thus generally mounted above and in close proximity to the woofer. Although the woofer and tweeter were now sharing the sound spectrum equally, octave wise, the net result was a diminution of the point source effect.

As used herein, the term "coincident" means that the adjacent bandwidth transducers radiate from the exact same point in space and time, e.g., a 1 inch dome tweeter mounted atop a woofer pole piece. By contrast, a horn tweeter in which the tweeter voice coil may be positioned some distance behind the woofer voice coil is non-coincident, but coaxial because the horn tweeter voice coil has a "horizontal" displacement with respect to the woofer voice coil. If this same horn tweeter were instead mounted flush with the front baffle/woofer, it would now have a "vertical" displacement regardless of whether it is above, below, to the left of or to the right of the woofer.

As used herein, the term "non-coincident" therefore means an arrangement in which the relative displacement between/among the transducers is vertically offset, horizontally offset, or both.

In the course of time, it became known that the proximity of the woofer to the tweeter in non-coincident systems becomes critical if it was desired that the off-axis dispersion pattern (usually vertical) at the crossover region remains smooth. The requirement is that they be separated (center-to-center) by no more than a wavelength at the crossover frequency. For example, two transducers crossed over at 3 kHz should be no more than about 4.5" apart, and two at 500 Hz should be no more than about 27.1" apart. The inference is that this separation is especially critical at higher crossover frequencies.

In order to make further gains in the afore-mentioned criteria, especially in medium to low efficiency systems where the moving mass was generally higher, transducers were further specialized so that three-way systems were eventually made. The same criteria for crossover networks were utilized as before except that a midrange transducer generally required a band pass filter that restricted both its low and high frequencies. The three transducers in this case were generally arranged in a vertical, geometric configuration with the woofer near the bottom of the loudspeaker cabinet, followed by the midrange transducer and the tweeter near the top of the cabinet. The arrangement of these three transducers was an even greater departure from the point source effect than the two-way systems. Another configuration of three transducers was a triangular arrangement which arguably enhanced the point source effect.

Four-way and five-way non-coincident loudspeaker systems have also been implemented (hereinafter loudspeaker systems with four or more transducers will be referred to as "multi-way").

Three-way and multi-way vertical alignments, with transducers generally arranged in sequential size order (with the largest transducer at the bottom and the smallest transducer at the top or vice versa) are quite common because they exhibit a generally smooth horizontal (left to right) polar pattern which is considered important in order to obtain a stable stereo image. However, these alignments are significantly incoherent, both on and off axis, as explained below.

Multi-way loudspeaker systems may have been constructed in consideration of the above recommendations pertaining to the criteria for choosing crossover points and the proximity of any two adjacent bandwidth non-coincident transducers. Their implementation was also influenced by the need to maintain at least a three-octave spread between crossover frequencies in a three-way system so as to minimize interference patterns between the transducers.

However, in prior art three-way and multi-way loudspeaker systems, there does not appear to be any recommendation or scientific method that pertains to proportioning adjacent bandwidth transducers with respect to relative size (radiation resistances). Radiation resistance of a transducer determines the power output and is a function of the frequency propagated, the method of coupling, and the size of the transducer. The radiation resistance of an unbaffled transducer in free air increases from a very low value to a value of approximately 42 acoustic ohms per square centimeter, which is the acoustic impedance of air. Maximum power will be transmitted to the air when the transducer approaches this impedance because the generator impedance will equal the load impedance. In the case of a circular diaphragm, this occurs when the diameter is equal to or slightly less than the wavelength being propagated. As the frequency increases and the wavelength is increasingly smaller than the diameter, the output power remains constant. However, in this event, the polar pattern becomes narrower and the higher frequencies are "beamed".

In the frequency range where the wavelengths are larger than the diameter of the diaphragm, a baffle or enclosure is required to prevent the front wave from canceling the rear wave, thus providing it with a proper load into which it operates to produce acoustic power (usually rated in acoustic watts).

If the wavelength or frequency is left unchanged, and the diameter of the transducer decreases, the radiation resistance per unit area drops, as does the power for that frequency. If the transducer size remained the same, and instead the wavelength increased (correlating to a reduction in the frequency), the ratio of the diameter of the transducer to the wavelength would also decrease, and again there would be a drop in the radiation resistance of the transducer and consequently less power would be radiated.

This explains a common phenomenon in the low frequencies: for a given low frequency, the smaller the transducer, the less the power output, and for a given size transducer, the low frequency power output will drop as the frequency is decreased. This phenomenon, however, is perhaps less noticed in the rest of the audible frequency range. It is a parameter which is almost entirely overlooked in that it is quite common to find two-way loudspeaker systems crossed over and which have adjacent diaphragm area ratios in the neighborhood of about 20:1 (e.g., a 178 mm woofer and a 28 mm tweeter) and although displaying smooth frequency responses, the power response (which is the power output, in acoustic watts, at all frequencies-on and off axis, usually into 180 degrees or $2\pi$ radians) is poor. Although power response is an absolute quantity, this is also a result of the large disparity in the relative radiation resistances of the two drivers (discussed below). Although moving coil (dynamic) transducers generally exhibit a somewhat variable mass characteristic (if the diaphragm is not overly rigid), they are still mass-controlled devices and respond accordingly.

An ideal loudspeaker or loudspeaker system would therefore propagate its power in radiation resistances which are independent of frequency (as in a continuum).

In addition to a lack of a recommendation regarding radiation resistances, in prior art three-way and multi-way loudspeaker systems, there also does not appear to be any recommendation or scientific method that pertains either to proportioning adjacent bandwidth transducers with respect to voice coil size and moving mass. Moreover, there does not appear to be any disclosure of geometrically configuring a three-way or multi-way loudspeaker system so that their combined outputs may coalesce at a defined point, or along a defined line in space, thereby unifying the resultant sound field into a virtual point source.

Without such a recommendation based on a scientific methodology, these design parameters have been left, to a greater or lesser extent, to the whim of the system designer, and therefore still reside in the area known as "black art". As a result, the vast majority of three-way and multi-way non-coincident loudspeaker systems, regardless of type, either have individual transducers incorrectly proportioned to one another, and thus do not seamlessly "blend" with each other (i.e., there are discernible transitions between adjacent bandwidth transducers resulting from an adverse interrelationship of diaphragm diameters, voice coil diameters, moving masses, efficiencies, overlapping bandwidths, crossover type and slope, etc.) and/or are incorrectly arranged geometrically and therefore do not behave as a virtual point source.

Disclosed herein is a multi-way loudspeaker that achieves both seamless "blending" and virtual point source behavior by relating the transducers to each other, and each transducer to the assembly of transducers.

A discussion will now be provided of various loudspeaker systems.

A first type is a multi-way planar electrostatic loudspeaker and a multi-way planar magnetic loudspeaker. Although these loudspeakers differ in the type of driving force utilized, they share the characteristic of being equally driven over most or all of their area (unlike a centrally-driven voice coil of a moving coil dynamic loudspeaker, or a dome type which is usually driven at its periphery). Since they are generally limited in their diaphragm excursion ability, this necessitates larger diaphragm areas for adequate sound pressure levels. As a result, these diaphragms are generally designed in the shape of long and narrow rectangles which are vertically oriented so that they have a wider horizontal than vertical dispersion, and as such, are not considered point sources, but plane wave or line sources.

Typically, the design criteria used for such loudspeakers is to make the diaphragm length, including the wall or floor reflection, larger than $\lambda/3$ (wavelength/three) for the lowest frequency of interest, and small compared to $\lambda/3$ for the highest.

Line sources typically display a "time smear" as the path lengths of the output waveform at primarily middle and high frequencies differ greatly from various parts of the diaphragm to the listener (at any reasonable distance). In the case of three-way or multi-way systems, the configuration itself generally adds incoherence to the "time smear".

In contrast to such prior art loudspeakers, disclosed below is a multi-way planar loudspeaker system which propagates a unified sound field along a single axis, and therefore behaves as a quasi virtual point source ("quasi" because since planar diaphragms are essentially driven equally over their entire area, the sound source does not collapse towards the center of the diaphragm as the frequency increases as in most cone-type moving coil transducers, and therefore are not intrinsically point sources). Additionally, dependent on size and complexity, the power output of a multi-way planar system in accordance with the invention may be virtually independent of frequency.

A second type of sound transducing system is a full frequency range single diaphragm condenser/electret condenser microphone. A microphone is in essence is a loudspeaker in reverse, i.e., the sound waves impinging on the diaphragm generates a voltage which is amplified, and then is either used for recording purposes or sent to a loudspeaker for sound reproduction or reinforcement purposes. Although there have been two-way microphones designed and manufactured, the overwhelming type currently known to be in existence are of the single diaphragm type. Of these, the four main types are the dynamic (moving coil), condenser (electrostatic), electret condenser (permanently charged electrostatic) and the ribbon (a type of dynamic).

In the condenser field, diaphragm sizes of ½" and 1" (circular) are the most common with the former generally considered the most accurate overall (of any type) both in frequency and transient response. The recording industry values other sizes and types for their unique "colorations" which, when utilized properly, enhance certain instruments and/or vocals. The larger 1" diaphragm condenser microphone, for example, is often preferred for vocals as it renders a "larger than life" sound when placed close to a vocalist.

Regardless of type, most if not all known microphones use diaphragms having a symmetrical shape, whether it is the radial symmetry of a circle or the bilateral symmetry of a rectangle. As such, these diaphragms, regardless of driving force, will tend to favor various bandwidths of frequencies solely in view of their shape.

Although the present approach is to use a microphone with the opposite characteristics of the instrument or vocal being recorded for a complementary result, the invention disclosed below, in view of the presence of a diaphragm having an asymmetrical shape, serves greatly to mitigate this requirement, as this shape does not favor any frequency or band of frequencies, but instead exhibits a virtually uninterrupted and seamless continuum of radiation resistances (in reverse) of all audible frequencies (commensurate with its size and complexity). An additional advantage of this asymmetrical shape characteristic is that the microphone may be designed specifically as left and right channel configurations. The embodiments of the invention disclosed below are particularly suited to condenser and electret condenser types, but are also applicable to single element, full range electrostatic speakers as discussed below. It is also applicable to headphones, hearing aids and other similar devices.

A third type of sound transducing system is a full range, single diaphragm electrostatic loudspeaker. Since electrostatic loudspeakers are resistance-controlled devices (as opposed to mass-controlled), a single diaphragm has been utilized for a full range high fidelity loudspeaker, albeit with lower efficiency being one of the tradeoffs. These full range, single diaphragm electrostatic loudspeakers have generally utilized large and generally curved symmetrical diaphragms (for greater output and lateral dispersion).

In the invention, using an asymmetrical, non-coincident diaphragm, a continuum of radiation resistances is obtained which is virtually independent of frequency, and a virtual point source characteristic is also obtained, as opposed to that of a line source as described above. Elimination of the crossover(s) and their attendant phase shifts is an additional benefit.

With respect to specific prior art, U.S. Pat. No. 3,645,355 to Long describes a loudspeaker system having a predetermined center-to-center spacing of two speakers. Reference is made to low frequency drivers only and the preferred spacing is from 6" to 9" apart for an allegedly improved high frequency roll off characteristic. No geometry is provided for the high frequency driver(s).

U.S. Pat. No. 3,824,343 to Dahlquist describes a multiple driver dynamic loudspeaker including an array of transducers which is not planar, but three-dimensional. The rise time characteristic is adjusted for adjacent pairs of transducers which are moved forwardly or rearwardly (horizontally) relative to each other so as to achieve a desired result.

U.S. Pat. No. 4,031,318 to Pitre describes a high fidelity loudspeaker system including multiple disparate drivers covering the same bandwidth of frequencies and arranged along three sides of a loudspeaker cabinet. The loudspeaker system utilizes a crossover network which is juxtaposed with a separately enclosed multiple driver mid frequency array which overlaps the output of the two-way, and utilizes only a high pass filter.

U.S. Pat. No. 4,119,799 to Merlino describes a loudspeaker cabinet system including two identical low frequency drivers spaced apart from one another such that a center to center distance is the piston diameter of the smaller driver times Pi ($\pi$). The reference is to low frequency drivers only and states that the high frequency driver or array may be positioned "thereabout". No overall geometry is given.

U.S. Pat. No. 4,730,694 to Albarino describes a high fidelity loudspeaker enclosure including multiple drivers in various configurations. No rationale is provided for the different configurations of drivers.

U.S. Pat. No. 4,885,782 to Eberbach describes loudspeaker driver configurations in which the symmetry in placement of the drivers is substantially more important than the distances between drivers. No precise geometry is provided for the location of the drivers. One array of drivers shows an angle of "turn" (centered on the tweeter) in excess of one hundred and fifty degrees (150°).

U.S. Pat. No. 5,164,549 to Wolf describes a sonic wave generator including concave baffles which are preferably dimensioned in a specific relationship relative to one another. For example, mention is made of a ratio of an upper to an immediately lower baffle of 1:0.66. No mention is made of the proportion of the transducers therein or the distances between them.

U.S. Pat. No. 5,430,260 to Koura et al. describes a speaker system utilizing four woofers and one tweeter. The patent pertains to a bilaterally symmetric configuration of woofers around a centrally mounted tweeter for controlled vertical dispersion.

The prior art does not disclose any specific, scientific methods for arranging transducers or drivers in a multi-way loudspeaker system.

OBJECTS AND SUMMARY OF THE INVENTION

It is an object of the present invention to provide a new loudspeaker that achieves both seamless blending of sound output from a plurality of transducers and virtual point source behavior by relating the position and size of the transducers to each other, and each transducer to the assembly of transducers.

It is another object of the present invention to provide a new multi-way planar loudspeaker system which propagates a unified sound field along a single axis, and therefore behaves as a quasi virtual point source.

It is another object of the present invention to provide a new multi-way planar loudspeaker system having a power output which is substantially independent of frequency.

It is yet another object of the present invention to provide a new microphone which has a uniquely shaped diaphragm which does not favor any frequency or band of frequencies and exhibits a virtually uninterrupted and seamless continuum of radiation resistances (in reverse) of all audible frequencies, while maintaining a point source pick up pattern.

It is still another object of the present invention to provide a loudspeaker with a single diaphragm having a unique shape and which is capable of obtaining a continuum of radiation resistances which is virtually independent of frequency, and a virtual point source characteristic.

In order to achieve these objects and others, a loudspeaker system in accordance with the invention includes a housing and at least four transducers arranged therein. Each transducer includes a diaphragm and the diaphragms, if circular in shape, are constructed with specific diameters such that the ratio of the diameter of each diaphragm to the diameter of an immediately larger diaphragm is between 1:1 and 1: $Phi^2$ ($Phi=(1+\sqrt{5})/2$), preferably 1:Phi, and the ratio of the diameter of each diaphragm to a diameter of an immediately smaller diaphragm is between 1:1 and $1:(1/Phi^2)$, preferably 1:1/Phi. Moreover, the diaphragms are arranged such that centers thereof lie on a spiral, clockwise or counterclockwise, in ascending size order with the center of the smallest diaphragm being closest to the pole of the spiral.

In one embodiment, the diaphragms are arranged such that the centers thereof lie on an equiangular spiral of approximately 73° (constant tangent angle) derived from a Golden Rectangle and the centers of adjacent diaphragms are separated by 90° angles of rotation from the pole. In another embodiment, the centers of the diaphragms lie on a spiral of approximately 75.6788° derived from a Golden Triangle having angles of 36°, 72° and 72° and the centers of adjacent diaphragms are separated by 108° angles of rotation from the pole. In yet another embodiment, the centers of the diaphragms lie on a spiral of approximately 81° and the centers of adjacent diaphragms are separated by 180° angles of rotation from the pole, i.e., all of the diaphragms have their centers on a single straight line.

Another embodiment of a loudspeaker system in accordance with the invention includes a housing and a single diaphragm arranged therein. The single diaphragm is in the shape of a spiral and is driven essentially over its entire area. The shape of the diaphragm may be obtained using the spirals discussed above to position the center points of the transducers (which, as a continuum, are not immediately apparent).

A microphone in accordance with the invention includes a housing, a diaphragm arranged in the housing and being in the shape of a spiral, a screen arranged in the housing and including apertures through which sound carries to the diaphragm, and a power supply, which, in this embodiment, provides voltage to the electrostatic plates. The shape of the diaphragm may be obtained using the spirals discussed above to position the center points of the transducers.

BRIEF DESCRIPTION OF THE DRAWINGS

The invention, together with further objects and advantages hereof, may best be understood by reference to the following description taken in conjunction with the accompanying drawings, wherein like reference numerals identify like elements, and wherein.

DETAILED DESCRIPTION OF THE INVENTION

Figure 1:
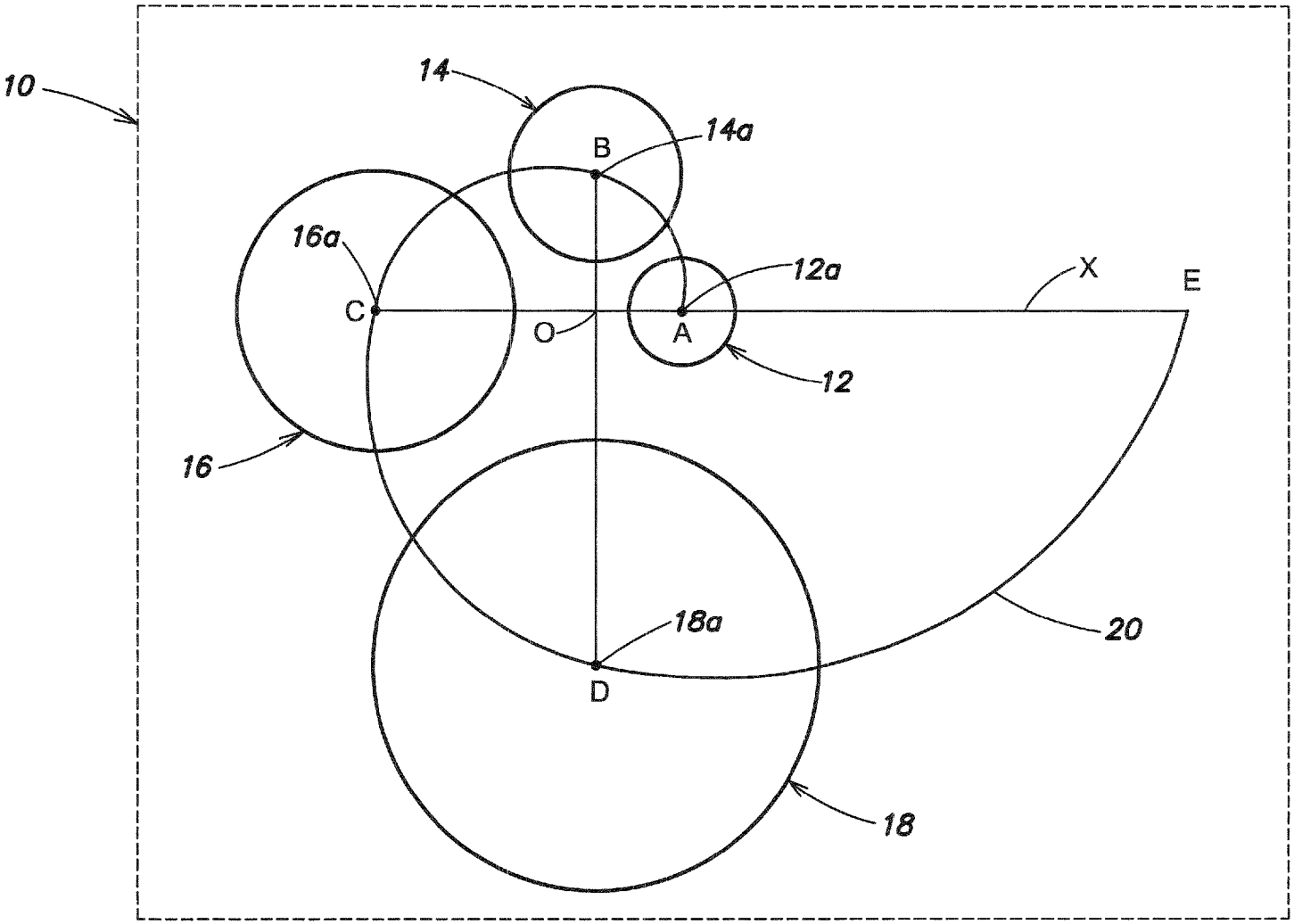
FIG. 1 is a schematic showing the dimensioning and absolute and relative positioning of transducers in a loudspeaker system in accordance with the invention.

Prior to referring to the drawings, a brief explanation of the nature of sound reproduction is beneficial. In view of the nature of sound reproduction and electromagnetic, mass-controlled transducers (i.e., those transducers possessing a characteristic of essentially being controlled by their mass), in order to adequately cover the full audible frequency range with uniformly excellent transient response and power response (the output power in acoustic watts at all frequencies, on and off axis, typically into a solid angle of 180 degrees of $2\pi$ radians), at least four specially designed transducers of comparable efficiencies and adequately overlapping frequency responses are required. The manner in which these four or more transducers are arranged is critical in the invention.

Specifically, it has been found that an optimum ratio for proportioning the specially designed adjacent bandwidth transducers with respect to the most relevant parameters, i.e., diaphragm diameters/areas, voice coil diameters, and moving masses, is independent of diaphragm shapes, materials, loading (e.g., horn loading), and crossover types, if any. As a result, a virtually seamless continuum of radiation resistances may be realized between any two adjacent bandwidth transducers resulting in dramatically improved sound reproduction.

This ratio is variously known as the Golden Mean, Golden Ratio, Golden Cut, Golden Section and Divine Proportion (hereinafter "Golden Section" or "GS" for short will be used) and is the ratio 1: (1+the square root of 5)/ 2, which to three decimal places is 1.618. In mathematics, it is represented by the Greek letter Phi, or $\Phi$. As this is a ratio, it is not necessarily meant to be an absolute, but a relative relationship pertaining to the parameters herein disclosed. Although loudspeakers vary greatly in efficiency and frequency range, it is the relative and not the absolute octave-to-octave radiation resistances which are generally important. In audio technology, the Golden Mean is perhaps most commonly found as a recommendation for the ratios of the length, width, and depth of loudspeaker enclosures so as to minimize standing waves, and is 0.618 : 1 : 1.618.

The Golden Section of a line is derived by dividing a line into mean and extreme ratios as follows:

A X B 1 C

There is only one point, B, on line AC such that $$\frac{AB}{BC} = \frac{AC}{AB}$$

Let AB=x and BC=1, then, $$\frac{x+1}{x} = \frac{x}{1} \text{ and } x^2 - x - 1 = 0$$

The positive solution is $$\frac{1+\sqrt{5}}{2},$$

and the negative solution is $$\frac{1-\sqrt{5}}{2}$$

which are 1.6180339 . . . and 0.6180339 . . . respectively.

Phi (Φ) is unique in that it is the only number which when diminished by one is its own reciprocal.

Although the diameter/area ratios are most important in determining the optimum relative radiation resistances for adjacent bandwidth transducers, the voice coil and mass ratios are also given as they contribute to "perspective" size and transient response respectively, and are a means to further optimize the continuity of the system.

It has been found that optimum ratios for proportioning adjacent bandwidth transducers, commensurate with compatible efficiencies and overlapping bandwidths are as follows:

If a given transducer parameter equals one, then the:

diameter of the next larger transducer=Φ or 1.6180339 . . .

diameter of next smaller transducer=1/Φ or 0.6180339 . . .

diameter of next larger voice coil (if any)=Φ or 1.6180339 . . .

diameter of next smaller voice coil (if any)=1/Φ or 0.6180039 . . .

area of next larger diaphragm=$\Phi^2$ or 2.6185273 . . .

area of next smaller diaphragm=$1/\Phi^2$ or 0.3819218 . . .

moving mass of next larger transducer=$\Phi^3$ or 4.2360672 . . .

moving mass of next smaller transducer=$1/\Phi^3$ or 0.236068 . . .

Notes

Diameter of the transducers does not include surround or edge suspension—specifications of transducer generally cite "effective" diameter which includes part of the surround suspension which on a relative basis is also valid.

Moving mass of the transducers is less air load for mass-controlled transducers only.

For the area of the diaphragms, for front-loaded horn low, mid, and high frequency transducers (especially exponential and hyperbolic types), the area is the mouth area, and the mass ratios may be disregarded, except in cases where the crossover frequency is appreciably higher than the horn load region, in which case, the diaphragm area and not the mouth area should be used. For rear-loading of the low frequency transducer, regardless of type (horn, reflex, transmission line, et al.), the additional area afforded by loading may also be disregarded. The voice coil ratio, however, should be applied in all cases (where applicable).

Referring now to FIG. 1, to provide a loudspeaker system in accordance with the invention which propagates its power in a continuum of radiation resistances which are virtually independent of frequency, a loudspeaker system 10 includes proportioned transducers 12, 14, 16, 18 arranged so that their combined outputs coalesce into a coherent and unified sound field along a common axis O (the intersection of the X and Y axes). The transducers 12, 14, 16, 18 each include a substantially circular diaphragm and are positioned in ascending size order (transducer 12 is the smallest, transducer 14 is larger than transducer 12, transducer 16 is larger than transducer 14 and transducer 18 is larger than transducer 16) on a counterclockwise Golden Section equiangular spiral 20 of approximately seventy-three degrees (exactly about 72.9676°) constant tangent angle, (this spiral being either counterclockwise or clockwise).

In this embodiment, the equiangular spiral 20 is derived from the Golden Rectangle. The center points 12*a*, 14*a*, 16*a*, 18*a* of the transducers 12, 14, 16, 18 are situated at any four or more consecutive points along this spiral 20, separated by ninety-degree) (90° angles of rotation from a common pole (designated O) so that the smallest transducer 12 is nearest the pole O, and all the transducers 12, 14, 16, 18, in ascending size order, are situated such that the centers of their diaphragms 12*a*, 14*a*, 16*a*, 18*a*, respectively, and thus their outputs, are perpendicular to the growth or expansion of the spiral 20.

The smallest transducer 12, i.e., a tweeter, typically exhibits the fastest rise time (defined as the time lag between the impressing of the applied voltage on the transducer and the diaphragm of that transducer responding to that voltage) and propagates the shortest wavelengths of sound. Therefore, transducer 12 is optimally positioned nearest the pole O or "focal point", and the sequentially larger proportioned transducers 14, 16, 18 which propagate successively longer wavelengths of sound are successively further away from the pole or focal point O and further away from each other.

In the Golden Section equiangular spiral 20 of approximately seventy-three degrees (73°) constant tangent angle, (72.9676°), the successive center points 12*a*, 14*a*, 16*a*, 18*a* separated by ninety-degree) (90° angles of rotation are not only Phi (Φ) (1.618 . . . ) times further from the pole O, they are also Phi (Φ) (1.618 . . . ) times further from the previous point along the spiral 20, either in line segments, or arc lengths. The 90° angles of rotation means that when lines are drawn between the pole O and the center points 12*a*, 14*a*, 16*a*, 18*a*, the angle between adjacent line segments is 90°, i.e., the adjacent line segments are perpendicular to one another.

Thus, the transducers 12, 14, 16, 18 are proportioned in Phi (Φ) ratio to each other. The ratio of the distances of transducers 12, 14, 16, 18 from the pole O, considering OA to be equal to 1, is therefore: OB=Phi times OA, OC=Phi times OB=$Phi^2$ times OA, OD=Phi times OC=$Phi^2$ times OB=$Phi^3$ times OA, and OE=Phi times OD=$Phi^2$ times OC=$Phi^3$ times OB=$Phi^4$ times OA. Moreover, the ratios of the distances of the transducers 12, 14, 16, 18 from each other either in line segments or arc lengths, considering AB to be equal to 1, is therefore: BC=Phi times AB, CD=Phi times BC=$Phi^2$ times AB and DE=Phi times CD=$Phi^2$ times BC=$Phi^3$ times AB.

The diaphragms of the transducers 12, 14, 16, 18 are dimensioned relative to each other such that each transducer 12, 14, 16, 18 has a diameter larger than the diameter of the immediately smaller transducer by Phi(Φ). That is, if the diaphragm of transducer 12, a tweeter, has a diameter of D1, then the diameter of the diaphragm of transducer 14 (designated D2), an upper midrange speaker, is Phi times D1, the diameter of the diaphragm of transducer 16 (designated D3), lower midrange speaker, is Phi times D2 or $Phi^2$ times D1. The diameter of the diaphragm of transducer 18 (designated D4), a woofer, is Phi times D3 or $Phi^2$ times D2 or $Phi^3$ times D1. The same relative size relationship continues for any additional transducers. An additional transducer would be centered at point E.

In preferred embodiments, any adjacent pair of transducers 12, 14, 16, 18 may be arranged on the spiral 20 such that their center-to-center distance is equal to, or less than a wavelength at the crossover frequency.

The dimensioning and absolute and relative positioning of the transducers 12, 14, 16, 18 in the loudspeaker system 10 creates a coherent and unified sound field in operation. It differs from existing loudspeaker systems in that prior art applications of an equiangular spiral in the field of high fidelity sound reproduction related to the shape of loudspeaker bass horns used to reinforce or "load" the rear of low frequency diaphragms (woofers) and the shape or partial shape of loudspeaker enclosures (B&W Nautilus). These prior art constructions are in essence parallel to, but not perpendicular to the spiral's expansion.

This method of geometrically configuring four or more sequentially GS-proportioned, specially designed transducers of compatible efficiencies and overlapping bandwidths, and preferably, but not necessarily crossed over to each other, combines and coalesces their respective bandwidths and corresponding outputs into a unified and coherent sound field along a single axis which corresponds to the pole of the GS equiangular spiral of approximately seventy-three degrees (73°) constant tangent angle.

Achieving Phi Φ ratios in quarter rotations (90°), or π/2 radians is unique to the equiangular spiral of approximately seventy-three degrees (73°) constant tangent angle, thereby making it the foundation for the preferred embodiments of the invention, as this attribute allows the four or more proportioned transducers 12, 14, 16, 18 to behave as a single sound source, along a single axis (the pole O of the spiral 20), and to possess the most coherent and unified sound field possible, commensurate with a virtual point source effect, in a non coincident arrangement of four or more transducers.

As mentioned above, spiral 20 is an equiangular spiral, which is a spiral that forms a constant tangent angle between a line drawn from the origin to any point on the curve and the tangent line at that point. It is distinctive because the size increases but the shape is unaltered, and this size increase is by accretion of material, i.e., it grows at one end only, each increment of length being balanced by a proportional increase in radius, thus the form is unchanged.

An equiangular (logarithmic) spiral has the polar equation $r=e^{a\theta}$ where r is the radius (radial vector), e is the base of the natural logarithm (2.718 . . . ), a is the constant growth rate and θ (theta) is the angle in radians. The variables r and θ are the polar coordinates of point P, and O is the pole located at the origin of the x and y axes. This equation plotted in polar coordinates generates an equiangular spiral.

Figure 2A:
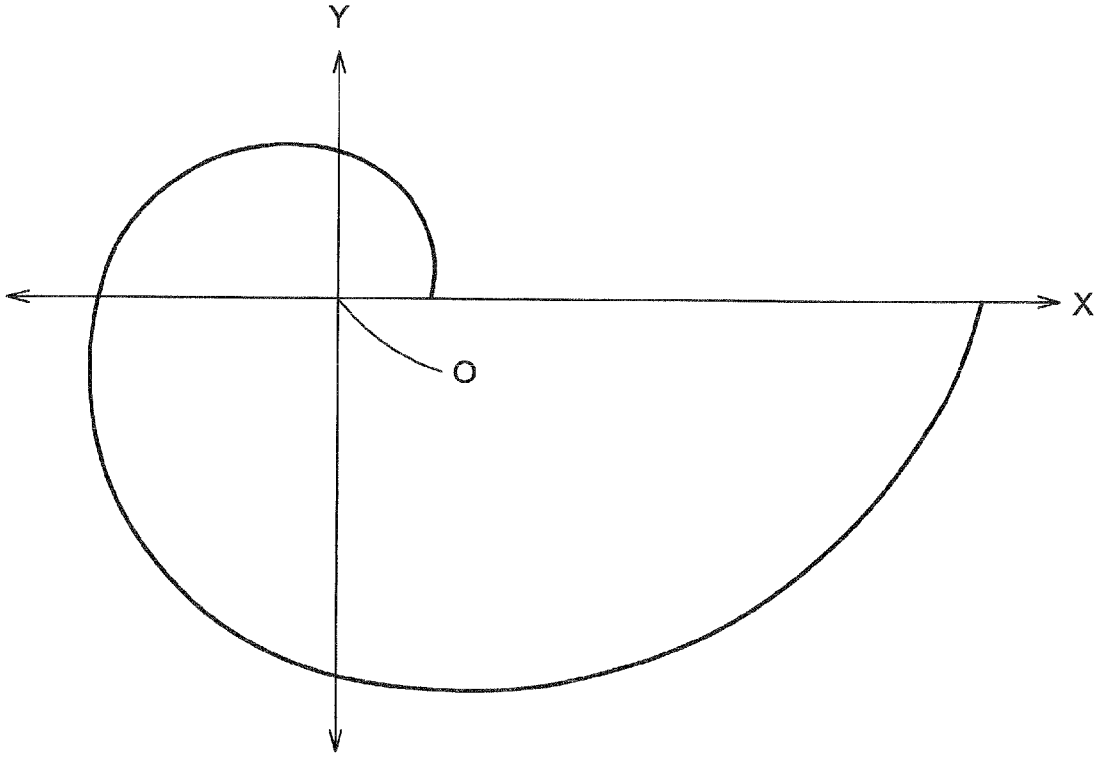
FIGS. 2A and 2B show equiangular spirals along which transducers are arranged for right and left channel constructions in accordance with the invention.
Figure 2B:
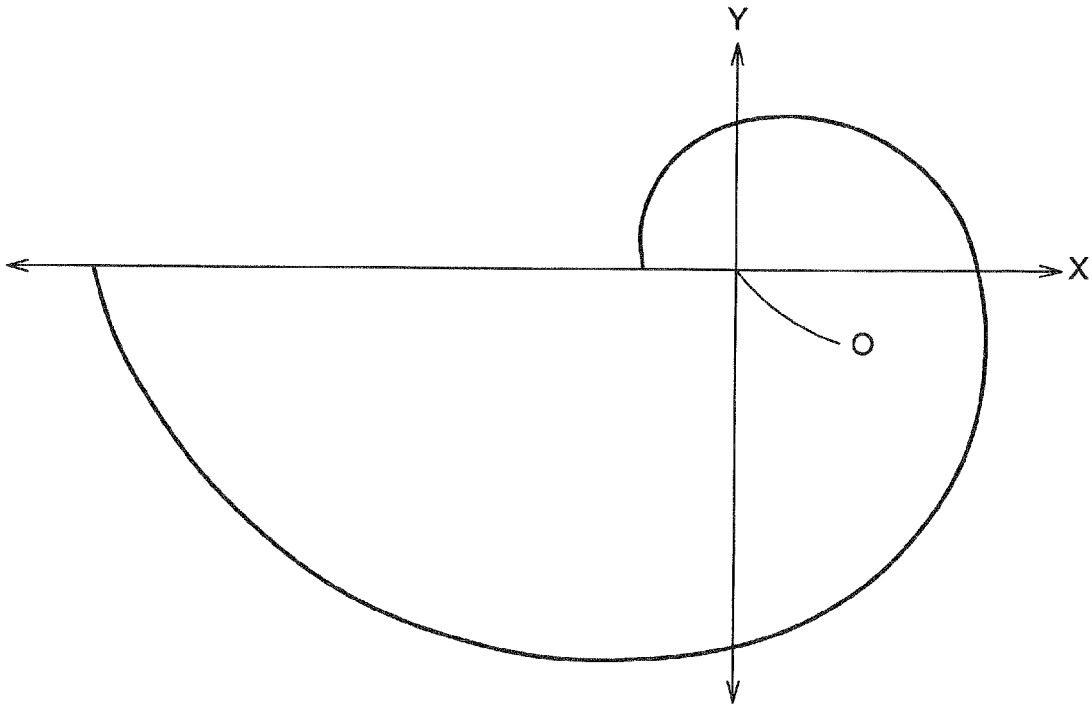

When a is positive, the distance r from the pole increases in a counterclockwise direction, resulting in a left-handed spiral. When a is negative, r decreases resulting in a right-handed, clockwise spiral. Thus, the curves $r=e^{a\theta}$ and $r=^{-a\theta}$ are mirror images of each other as shown in FIGS. 2A and 2B.

In one embodiment of the invention, mirror image equiangular spirals are employed for the left and right channel geometric configurations of loudspeakers and microphones. Preferably, the left channel is constructed based on the equiangular spiral in the counterclockwise direction while the right channel is constructed based on the equiangular spiral in the clockwise direction.

An important feature of an equiangular spiral is that if the angle θ is increased by equal amounts (arithmetically), the distance r from the pole O is increased by equal ratios, i.e., as a geometric progression. For an equiangular spiral of approximately seventy-three degrees (73°) constant tangent angle, every ninety-degree (90°) increase in the angle θ is 1.618 . . . (Phi) times further from the pole O, and the successive lengths of arcs or straight-line segments are also in the same ratio. Thus, each ascending size transducer along such an equiangular spiral is not only Φ (Phi) times further from the pole O than the immediately previous (smaller) transducer, but also 0 times the distance to the previous transducer at ninety degree (90°) increments of rotation from the pole O (see FIG. 1).

There are two well-known methods in which to construct an equiangular spiral of approximately seventy-three degrees (73°) constant tangent angle utilizing a ruler and compass only. This would then be used to position the transducers 12, 14, 16, 18 relative to one another and on the equiangular spiral 20.

One method is from the inside out, and uses additive squares of the Fibonacci sequence of numbers; 1, 1, 2, 3, 5, 8, 13, 21, 34, 55, 89, 144, etc. This is a recursive sequence in that each number except the first is the sum of the two previous numbers. In its higher reaches, any number either divided by the previous number or by the one following it results in close approximations of Φ (Phi) or 1/Φ(one divided by Phi) respectively.

Figure 3:
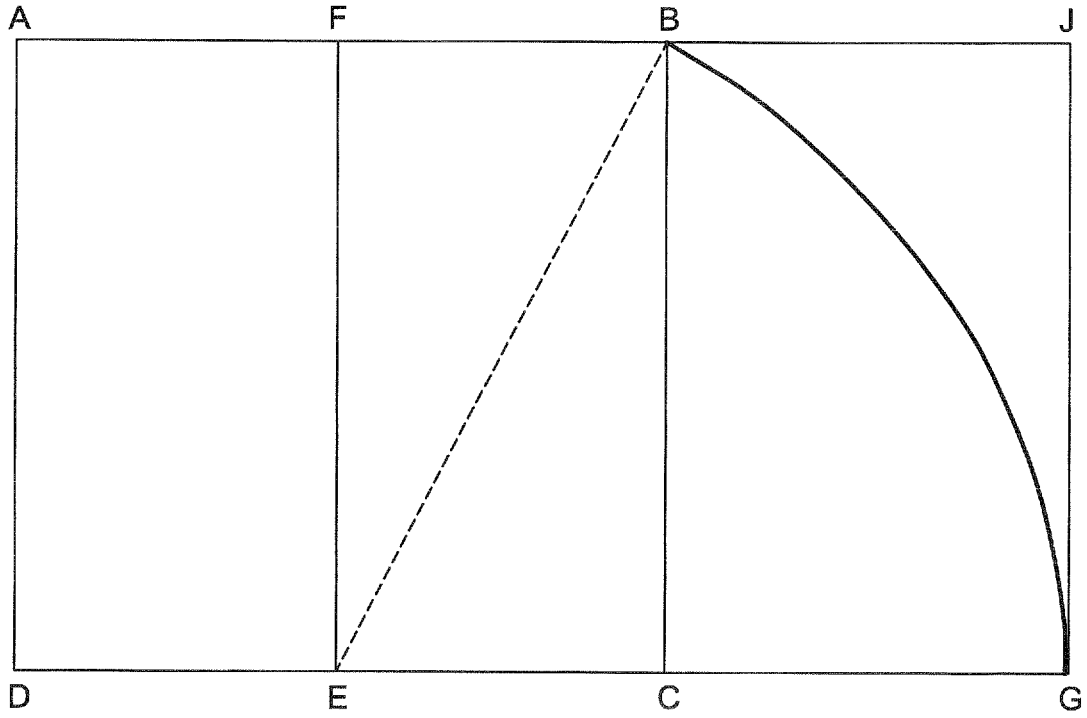
FIG. 3 shows one manner for constructing a Golden Rectangle in accordance with the invention.

The other method of constructing an equiangular spiral of about 73' constant tangent angle with a ruler and compass only, is from the outside in, and uses the Golden Rectangle as a basis for construction. To do this, we must first construct a Golden Rectangle as shown in FIG. 3. Step 1 is to construct square ABCD, step 2 is to locate E which is the midpoint of line segment DC and then, using E as the center, and EB as the radius, an arc is traced that intersects extended side DC at G. A line perpendicular to DG is constructed at G and side AB is extended to J. The resultant rectangle defined by points AJGD is called a Golden Rectangle with a width to length ratio of θ to 1, or 1 to 1/θ.

This method of construction, as it begins with a Golden Rectangle, commences from the outside in and may diminish to a virtual singularity. If need be, however, it may also be continued outwardly by simply adding squares to the longer sides of the rectangles. This spiral, although very similar to the previous one, is not a growth spiral as it does not begin with unity and attain very close approximations of Phi (Φ) in its higher reaches only, but instead generates Phi (Φ) accurately throughout.

Figure 4:
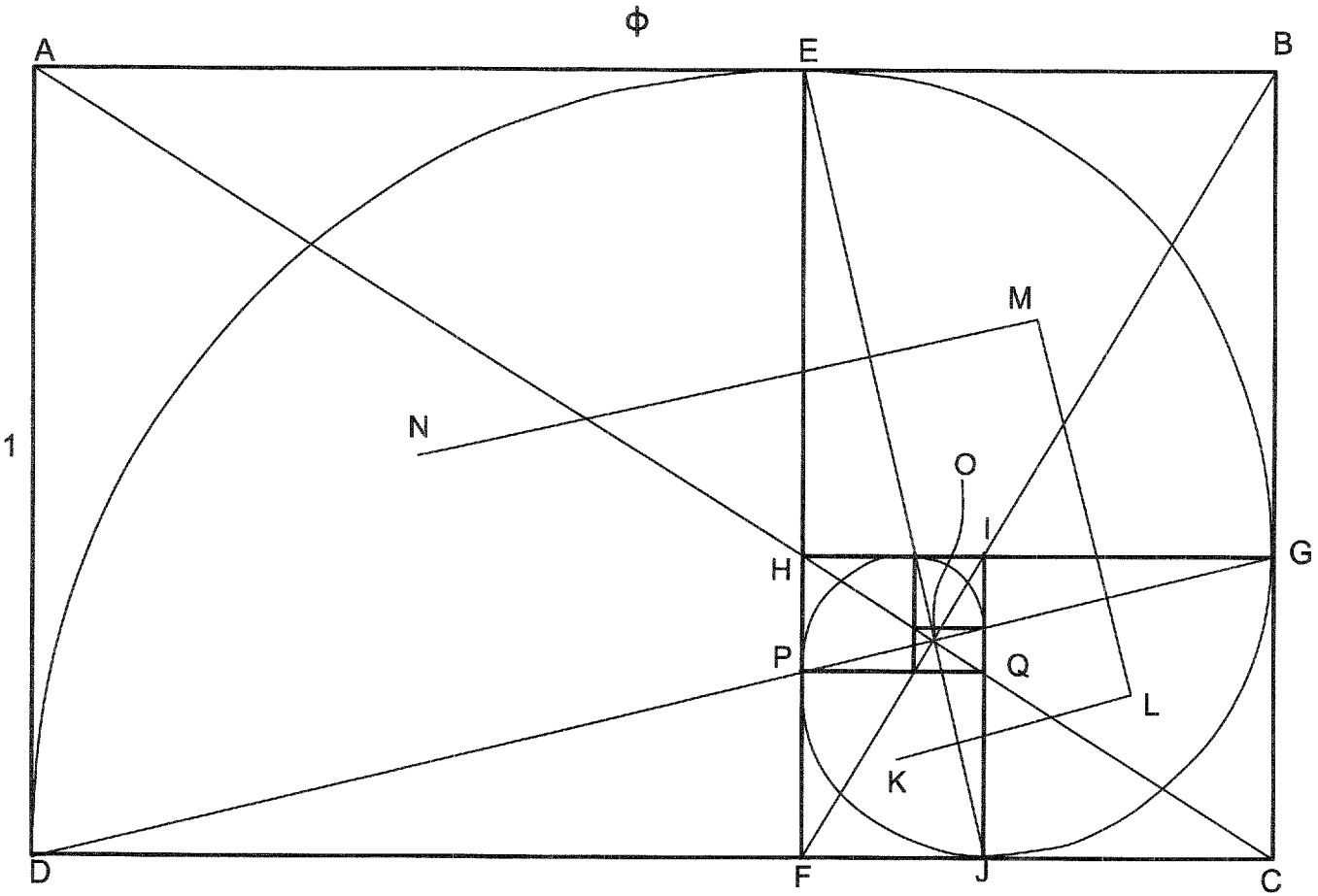
FIG. 4 shows another manner in which to determine the positions of transducers in a loudspeaker system in accordance with the invention.

To illustrate the continued inward progression, FIG. 4 shows a rectangle defined by points ABCD in which AB:BC=Φ:1. Through E, the Golden Cut of line segment AB, line segment EF is drawn perpendicular to line segment AB, cutting off from the rectangle the square defined by points AEFD. Then, the remaining rectangle defined by points EBCF is a Golden Rectangle. If from this, square EBGH is lopped off, the remaining rectangle defined by points HGCF is also a Golden Rectangle. This process can be repeated indefinitely until the limiting rectangle O, indistinguishable from a point is reached. These squares thus constructed are gnomons to the remaining rectangles, which are themselves similar to the original rectangle.

The limiting point O is called the pole which passes through the Golden Cuts D,E,G,J, . . . . The sides of the rectangle are nearly, but not quite tangential to the curve. Alternate Golden Cuts on the rectangular spiral defined by points A, B, C, F, H, . . . lie on the diagonals AC and BF which are mutually perpendicular. Points E, O, J, are collinear (lying on the same line), as are the points D, G, O. The four right angles at pole O are bisected by line segments EJ and DG so that these lines are mutually perpendicular. The ratio of $$\frac{AO}{OB}$$

is equal to $$\frac{OB}{OC}$$

is equal to $$\frac{OC}{OF}$$

. . . There are an infinite number of similar triangles, each being one half of a Golden Rectangle. However different two segments of the curve may be in size, they are not different in shape. As previously stated, any two radii separated by an angle of 90° are in the ratio of Φ:1 or 1/Φ:1, so that successive segments of the curve or of the rectangular spiral are also in the same ratios.

Referring to FIG. 4, the following are appropriate locations for the centers of sequentially proportioned transducers 12, 14, 16, 18 according to the methods disclosed herein for constructing a loudspeaker system 10, irrespective of shape, and configured so that their diaphragms are perpendicular to the expansion of the curve. Examples are for four-way systems, however, this may be increased indefinitely.

A. Arrangement of Transducers Based on Centers of their Diaphragms

1. FCBA is a rectangular spiral of four points appropriate for the diaphragm centers such that if FC=1, then CB=Φ and BA=$\Phi^2$ and if OF=1, then OC=Φ, OB=$\Phi^2$, and OA=$\Phi^3$ 2. JGED (the appropriate points where the diagonals of the squares almost intersect the equiangular spiral) such that if JG=1, then GE=Φ, ED=$\Phi^2$ and if OJ=1, then OG=Φ, OE=$\Phi^2$, and OD=$\Phi^3$ 3. KLMN are appropriate points at the centers of the squares such that if KL=1, then LM=Φ, and MN=$\Phi^2$ and if OK=1, then OL=Φ, OM=$\Phi^2$, and ON=$\Phi^3$ 4. Any four or more points about the pole, either consistently along the curve or on a rectangular spiral so described, provided they are in 90° increments of rotation about the pole.

B. Arrangement of Transducers Based on Area or Shape (Note that when the shape utilized is irregular, the center of the diaphragm may be determined by locating its center of gravity (of a uniform sheet), which is particularly useful for electrostatic and planar magnetic transducers).

1. By squares, if area of square PQJF=1, then the area of square IGCJ=$\Phi^2$ times the area of PQJF, the area of square EBGH=$\Phi^4$ times the area of PQJF, and the area of square AEFD=$\Phi^6$ times the area of PQJF (successively larger squares are $\Phi^2$ times the area of the previous one)

2. By quarter circles (quarter circles are used as approximations only to the actual curve, as the actual curve would require polar graph paper)

area of quarter circle DEF is $\Phi^2$ times the area of quarter circle EGH, the area of quarter circle EGH is $\Phi^2$ times the area of quarter circle GJI, and the area of quarter circle GJI is $\Phi^2$ times the area of quarter circle JPQ, etc.

From the foregoing, it can be seen that the Golden Rectangular spiral provides a convenient and straightforward method of enabling the positions of transducers of a loudspeaker system in accordance with the invention to be determined. Specifically, as shown in FIG. 4, the points F, C, B, A can be used to position the centers of the diaphragms of the transducers 12, 14, 16, 18. For example, if FC=1, then CB=Φ and BA=$\Phi^2$, and if BA=1, then CB=1/Φ, and FC=1/$\Phi^2$. AC and BF are mutually perpendicular and locate the pole P.

It is a unique feature of the equiangular spiral of approximately) (73° constant tangent angle that as the radial vectors are in GS (Phi) Φ ratios in 90° rotations of the pole, the successive segments of the rectangular spiral are perpendicular to each other, and are therefore also 90° (included angles or turns). This unique feature is the key reason it outperforms all other spirals for the purposes herein stated.

Figure 5:
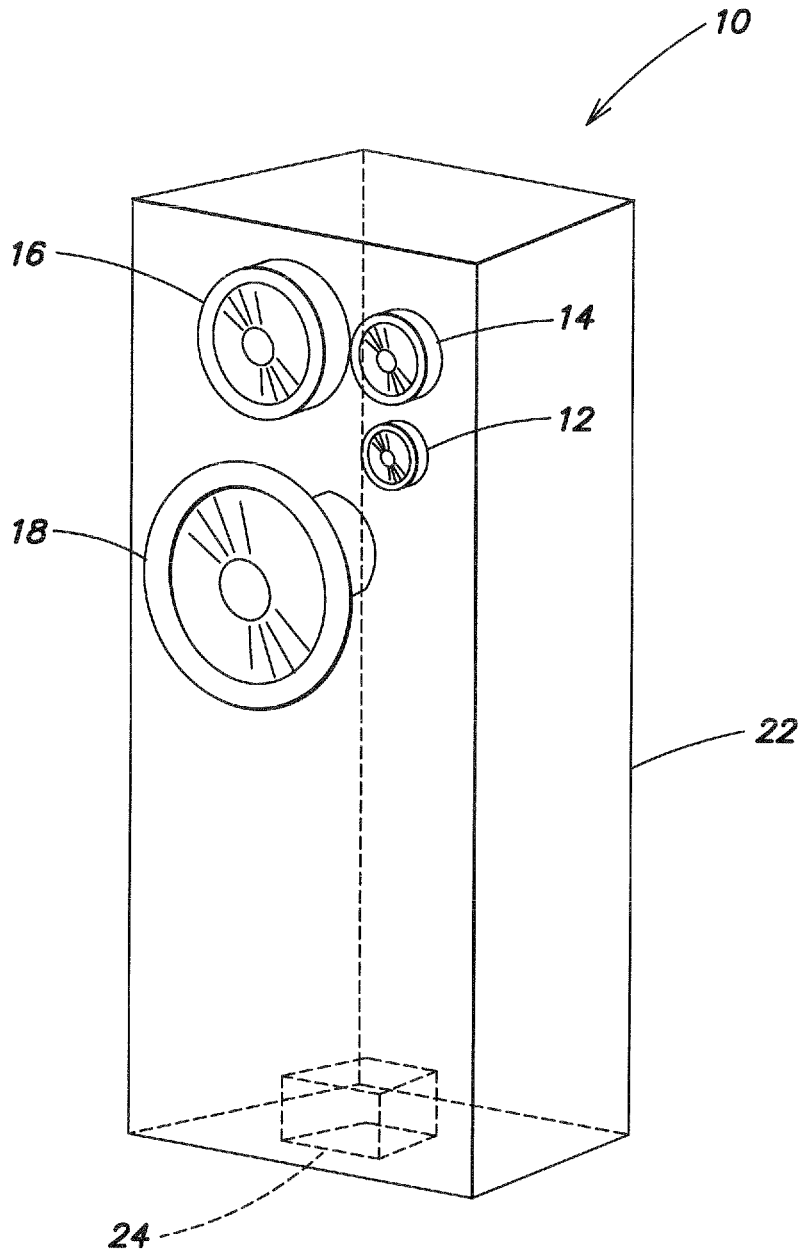
FIG. 5 is a perspective view of a loudspeaker system in accordance with the invention.

In consideration of the foregoing discussion about forming an equiangular spiral and determining the relative position for transducers, reference is now made to FIG. 5 wherein a first embodiment of the invention is shown in its entirety. The loudspeaker system 10 includes a housing or cabinet 22, which as shown is self-standing. The loudspeaker system 10 employs a counter clockwise or left-handed Golden Rectangular spiral configuration appropriate for the left channel of a mirror-imaged pair utilizing the unified field array herein disclosed. Transducers 12, 14, 16, 18 are configured on an equiangular spiral of approximately 73° constant tangent angle, each separated by 90° rotations from the pole, and sequentially proportioned by the Golden Section (Φ). A crossover 24 is provided at a bottom of the cabinet 22. The electrical connections between the crossover 24 and the transducers 12, 14, 16, 18 are not shown for clarity purposes.

An advantage of the relative dimensioning of the transducers 12, 14, 16, 18, the absolute position of the transducers 12, 14, 16, 18 on a spiral and the position of the transducers 12, 14, 16, 18 relative to one another provides a number of significant advantages. For example, when the individual transducers 12, 14, 16, 18 (which determine the power output and is a function of the frequency being propagated, the method of coupling, and the size of the transducer) are proportioned and configured in a relationship of four or more as described above, their outputs coalesce into a perfectly proportioned, full frequency range, virtual continuum of radiation resistances along a single common axis. Depending on size and complexity of the loudspeaker system 10, the ideal loudspeaker which propagates its power in radiation resistances which are virtually independent of frequency may be realized.

Another advantage is that as the spiral length increases to accommodate more complex multi-way systems of four or more-ways, the coherence and point source effect increases, which is the exact opposite result of sequentially proportioned vertically arrayed systems (as in the prior art). This allows the loudspeaker designer almost total design freedom (crossover type and slope notwithstanding) as it is well known in the art that multiple electronic and/or passive crossovers may be combined to this end without undo detriment.

Yet another advantage is that as the virtual point source effect is manifested along a single axis (the pole of the spiral), this remains constant through a 360° rotation about the pole. Although the off-axis polar response will undergo variations through this rotation, the on-axis response will not. In this regard, therefore, it is more similar to a coaxial configuration (generally confined to two-way configurations) than is possible in any other arrangement of four or more specialized adjacent bandwidth non-coincident transducers, allowing horizontal or vertical placements of the embodiment to be less critical vis-à-vis performance.

Thus, a loudspeaker system 10 is provided which operatively creates a virtually coherent sound field along a single axis and includes four or more specially designed transducers 12, 14, 16, 18 (crossover type, if any, notwithstanding).

Although four transducers are shown, a fifth transducer would be positioned along the spiral in the same relationship as the second, third and fourth transducers so that all of the transducers 12, 14, 16, 18 are sequentially proportioned in diaphragm area, voice coil diameter, and moving mass, in accordance with the Golden Section ratio. Furthermore, the transducers 12, 14, 16, 18 are sequentially located at successive points on the equiangular spiral of approximately 73°) (72.9676° constant tangent angle, which are also in the Golden Section ratio to each other, and to the pole. Their location at these specific points is such that the axial centers of the diaphragms of the transducers 12, 14, 16, 18 are located at these points, and simultaneously perpendicular to the expansion of the spiral. These part-to-part (transducer-to-transducer), and part-to-whole (transducer to loudspeaker system) relationships are such that the respectively assigned frequency bandwidths of these transducers 12, 14, 16, 18 display their power output in a continuum of radiation resistances which is virtually independent of frequency, and combine along a single axis at the pole of the spiral, and thus behave like a single, full frequency range virtual point source that no single (moving coil) transducer or any other arrangement of specialized adjacent bandwidth non-coincident transducers may outperform. Left and right channel configurations are intrinsic to the design, and beneficial to stereophonic imaging.

Figure 6:
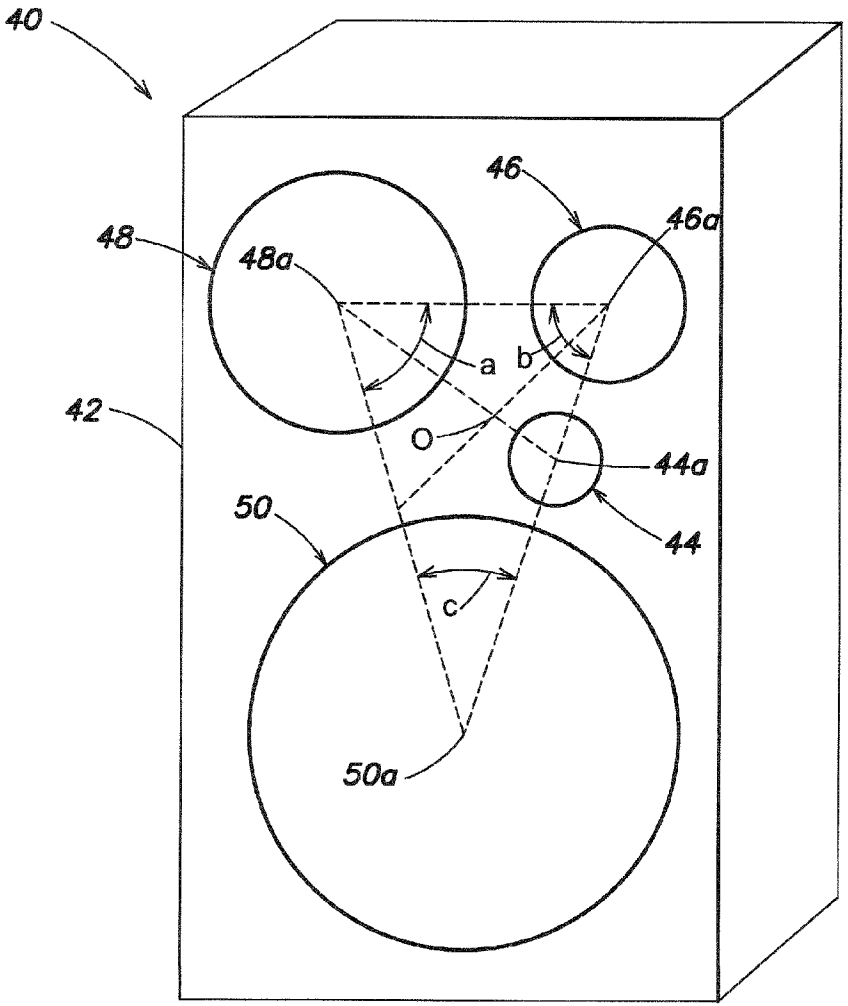
FIG. 6 is a perspective view of another embodiment of a loudspeaker system in accordance with the invention.

Another embodiment of the invention is shown in FIG. 6 wherein the loudspeaker system 40 comprises a housing 42 and four transducers 44, 46, 48, 50, each having a circular diaphragm. Instead of arranging the diaphragms of the transducers 44, 46, 48, 50 based on a Golden Rectangle equiangular spiral, the diaphragms are arranged on a spiral based on a Golden Triangle (angle a=72°, angle b=72°, angle c=36°). The relative size relationship between the transducers 44, 46, 48 and 50 is the same as for the transducers 12, 14, 16, 18 in the embodiment described above. The center points 44*a*, 46*a*, 48*a*, 50*a* of the diaphragms of the transducers 44, 46, 48, 50 lie on the Golden Triangle spiral (with the pole at O).

A spiral based on or derived from the Golden Triangle has a constant tangent angle which is greater than 73° constant tangent angle (specifically about 75.6788°), and achieves Phi (Φ) ratios in 108° rotations, or 3π/5 radians, instead of 90°, or π/2 radians in the case of the equiangular spiral based on the Golden Rectangle. This spiral may also be constructed using the gnomon principle previously described, however, an explanation of this construction will not be provided in favor of explaining a simpler method which utilizes a triangular spiral.

Figure 7:
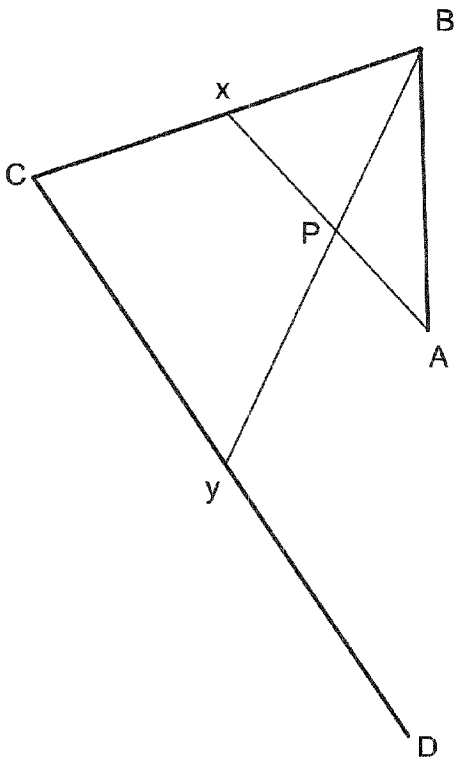
FIG. 7 is a schematic showing the manner in which the positions of the transducers in the loudspeaker system shown in FIG. 6 are determined.

Referring to FIG. 7, if the length of line segment AB=1, then the length of line segment BC=Φ, and the length of line segment CD=$\Phi^2$. All turns clockwise or counterclockwise are seventy-two degrees) (72° (included angles). The center points 44*a*, 46*a*, 48*a*, 50*a* of the diaphragms of the transducers 44, 46, 48, 50 are designated A, B, C, and D, respectively, in FIG. 7. X is the midpoint of side BC while Y is the midpoint of side CD. The transducers 44, 46, 48, 50 are thus positioned relative to one another such that if the length of line segment AB=1, then the length of line segment BC=Φ, and the length of line segment CD=$\Phi^2$.

Figure 8:
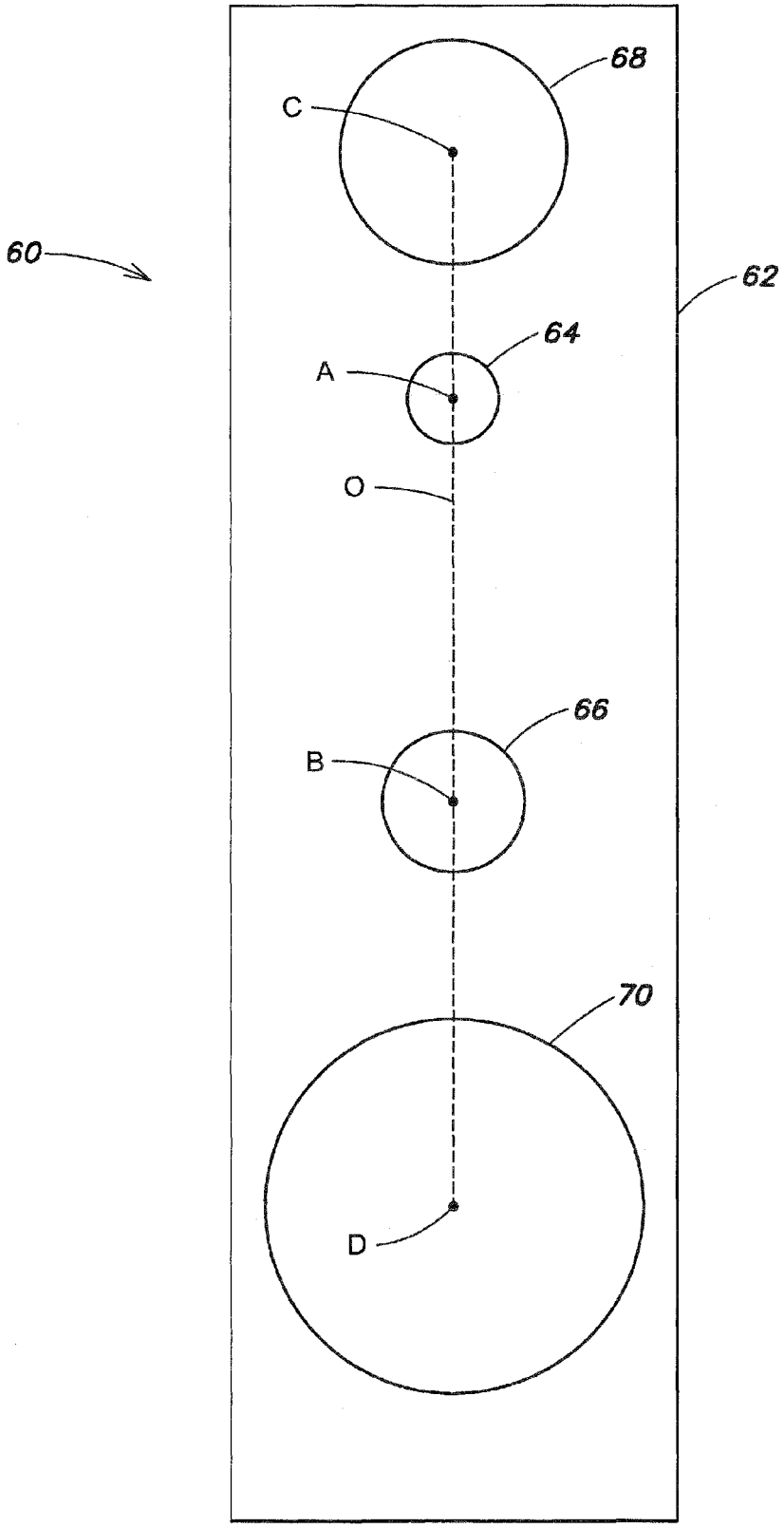
FIG. 8 is a front view of another embodiment of a loudspeaker system in accordance with the invention.

Referring now to FIG. 8, in another embodiment of the invention, a loudspeaker system 60 includes a housing 62 and four transducers 64, 66, 68, 70 having the same relative size as discussed above with respect to transducers 12, 14, 16, 18. However, in this embodiment, the transducers 64, 66, 68, 70 are arranged such that the centers of the diaphragms thereof (designated A, B, C, D, respectively) lie on a common line extending through the pole O. Another way of considering this embodiment would be to consider that the centers of the diaphragms of the transducers 64, 66, 68, 70 lie on a rectilinear spiral which is folded onto itself. This spiral, which is approximately 81°) (81.29143573° constant tangent angle, achieves Phi (Φ) ratios in 180° rotations about the pole O, or n radians. That is, the centers of the diaphragms are separated from one another by 180° about the pole O.

Housing 60 may take any form desired by the designer, including but not limited to the self-standing rectangular form shown in FIG. 8.

Transducer 64 is a tweeter, transducer 66 is an upper midrange speaker, transducer 68 is a lower midrange speaker and transducer 70 is a woofer. The transducers 64, 66, 68, 70 are positioned relative to one another such that if the length of line segment OA=1, then the length of line segment OB=Φ, the length of line segment OC=$\Phi^2$ and the length of the line segment OD=$\Phi^3$.

Although other configurations between 108° angle of rotations between the centers of the diaphragms of the transducers (derived from the Golden Triangle) and 180° rotations (straight line) are possible, e.g., those based on equilateral triangles or variants of a Golden Triangle which have a short base and two long sides (36°, 36°, 72°), the 180° rotation is a preferred construction since it is practical and provides a compact vertical configuration of transducers. Even though this configuration does not permit all of the transducers to be spaced less than a wavelength apart at the crossover frequency for a smooth off-axis response (vertically), the pole of the equiangular spiral resides within the array and therefore, the on-axis "focus" still displays the virtual point source effect discussed above.

It should be understood that in terms of "point locations" and "angles of turns" of straight line spirals, GS Phi (Φ) ratio rotations about the pole of between one (1°) (i.e., more than 0°) and one hundred seventy nine degrees (179°) (i.e., less than 180°) are counterclockwise spirals, and rotations of between one hundred eighty one degrees (181°) (i.e., more than 180°) and three hundred and fifty nine degrees (359°) (i.e., less than 360°) are clockwise spirals.

Further, it should be understood that in the specific cases of 180° rotations or Phi (Φ) in Pi (π) radians, and 360° rotations or Phi (Φ) in 2 Pi (2π) radians, these may be either counterclockwise or clockwise rotations as the "point locations" and "angles of turns" are the same, (continuous spiral transducer constructions notwithstanding), and the Phi (Φ) ratios lie on straight lines. However, in the latter case, the pole is situated outside the array and therefore will sound much less coherent than those herein disclosed. This latter arrangement is essentially identical to typical three and four-way etc., vertical alignments with transducers in sequential size order, thus explaining why these sound less coherent.

Figure 9:
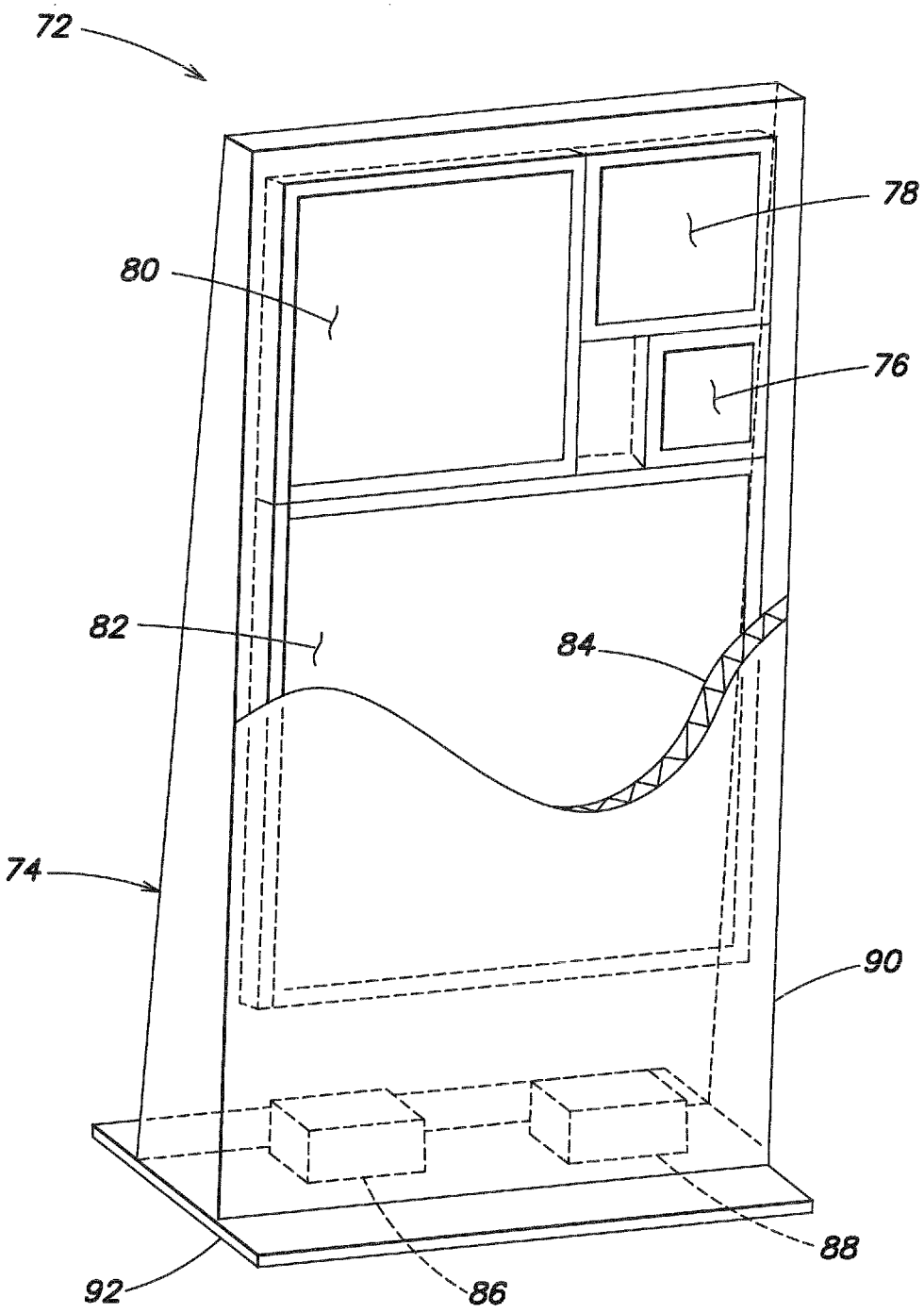
FIG. 9 is a perspective view of another embodiment of a loudspeaker system in accordance with the invention.

Referring now to FIG. 9, a multi-way planar loudspeaker design based on an equiangular spiral of approximately 73° constant tangent angle is shown. That is, the centers of the diaphragms of the transducers are arranged on this equiangular spiral. Other spirals, such as those based on the Golden Triangle previously discussed, are also envisioned for this embodiment of the invention but it is expected that coherence will not be as great as for the equiangular spiral of 73°. Thus, the diaphragms may be constructed to have the shape of an equiangular spiral with a constant tangent angle of anywhere between about 65° and about 82°, e.g., between about 65.3201098° and about 81.29143573°.

As shown in FIG. 9, a four-way full-range electrostatic loudspeaker 72 includes a housing 74 with square-shaped transducers 76, 78, 80, 82, which is practical for an electrostatic or planar magnetic loudspeaker. The loudspeaker 72 uses a counterclockwise or left-handed spiral, most appropriate for left channel use. However, this does not preclude more ambitious spiral configurations as this geometry accommodates complexity to the extent that the virtual point source effect is actually enhanced by it.

Transducer 76 is a tweeter, transducer 78 is an upper midrange speaker, transducer 80 is a lower midrange speaker and transducer 82 is a woofer. Housing 74 includes a grille 84 in front of the transducers 76, 78, 80, 82, a high voltage power supply 86 (electrostatic only) and a crossover 88. The electrical connections of the power supply 86 and crossover 88 are not shown. The housing 74 also includes a baffle board or frame assembly 90 in a front panel and a base 92 which enables the housing 74 to be self-standing. The shape of the housing 74 is not limited to that shown and other shapes of housings can be used with the transducers 76, 78, 80, 82.

Loudspeaker 72 provides essentially the same advantages as the loudspeaker system 10 as described above. However, the loudspeaker system in accordance with the invention is now transformed from a semi-coherent two or three-way geometric configuration of transducers 12, 14, 16, 18, which exhibit "time smear" due to their radiation as a plane wave, to a time coherent (quasi) spherical wave generating, virtual point source. Left and right channel mirror-imaged pairing is intrinsic to the design, and an additional advantage.

In addition to the construction of loudspeaker systems based on the spirals described above, it is also possible to construct loudspeaker systems in accordance with the invention using spirals based on planar geometric polygons which are not themselves in Golden Proportions or are only partially in Golden Proportions. Exemplifying planar geometric polygons of the first kind include an equilateral triangle (which achieves Phi (Φ) in 2π/3 radians or 120° rotations of the pole). A planar geometric polygon of the second kind includes a right triangle in which two of three sides are in Golden Proportion (this is also ½ of a Golden Rectangle cut on the diagonal). It is also possible to use spirals derived from a variation of a Golden Triangle in which the angles are 36°, 36° and 72°. Loudspeaker systems constructed using such spirals generally will render less coherence, as the virtual point source effect will be affected adversely in comparison to the equiangular spirals derived from the Golden Rectangle and Golden Triangle as discussed above.

Various relationships between the parameters of the diaphragms of the transducers in any of the embodiments described above are possible. For example, the ratio of a diameter of each diaphragm to the diameter of an immediately larger diaphragm may be between 1:1 and 1:$Phi^2$, preferably 1:Phi, and the ratio of the diameter of each diaphragm to the diameter of an immediately smaller diaphragm may be between 1:1 and 1:(1/$Phi^2$), preferably 1:(1/Phi), the diameter being an actual piston diameter, an effective or emissive diameter or a voice coil diameter. Also, a ratio of a line segment or distance between the pole and the center of each diaphragm to the line segment or distance between the pole and the center of an immediately larger diaphragm may be between 1:1 and 1:$Phi^2$, preferably 1:Phi, and the ratio of the line segment or distance between the pole and the center of each diaphragm to the line segment or distance between the pole and the center of an immediately smaller diaphragm may be between 1:1 and 1:(1/$Phi^2$), preferably 1:(1/Phi). A ratio of an area of each diaphragm to the area of an immediately larger diaphragm may be between 1:1 and 1:Phi', preferably 1:$Phi^2$, and a ratio of the area of each diaphragm to the area of an immediately smaller diaphragm may be between 1:1 and 1:(1/$Phi^4$), preferably 1:1/$Phi^2$.

When the diaphragms are mass-controlled and include moving mass, the moving mass ratio may also be considered to design the loudspeaker system. The ratio of the moving mass of each diaphragm to the moving mass of an immediately larger diaphragm may be between 1:1 and 1:$Phi^5$, preferably 1:$Phi^3$, and the ratio of the moving mass of each diaphragm to the moving mass of an immediately smaller diaphragm may be between 1:1 and 1:(1/$Phi^5$), preferably 1:(1/$Phi^3$).

Figure 10:
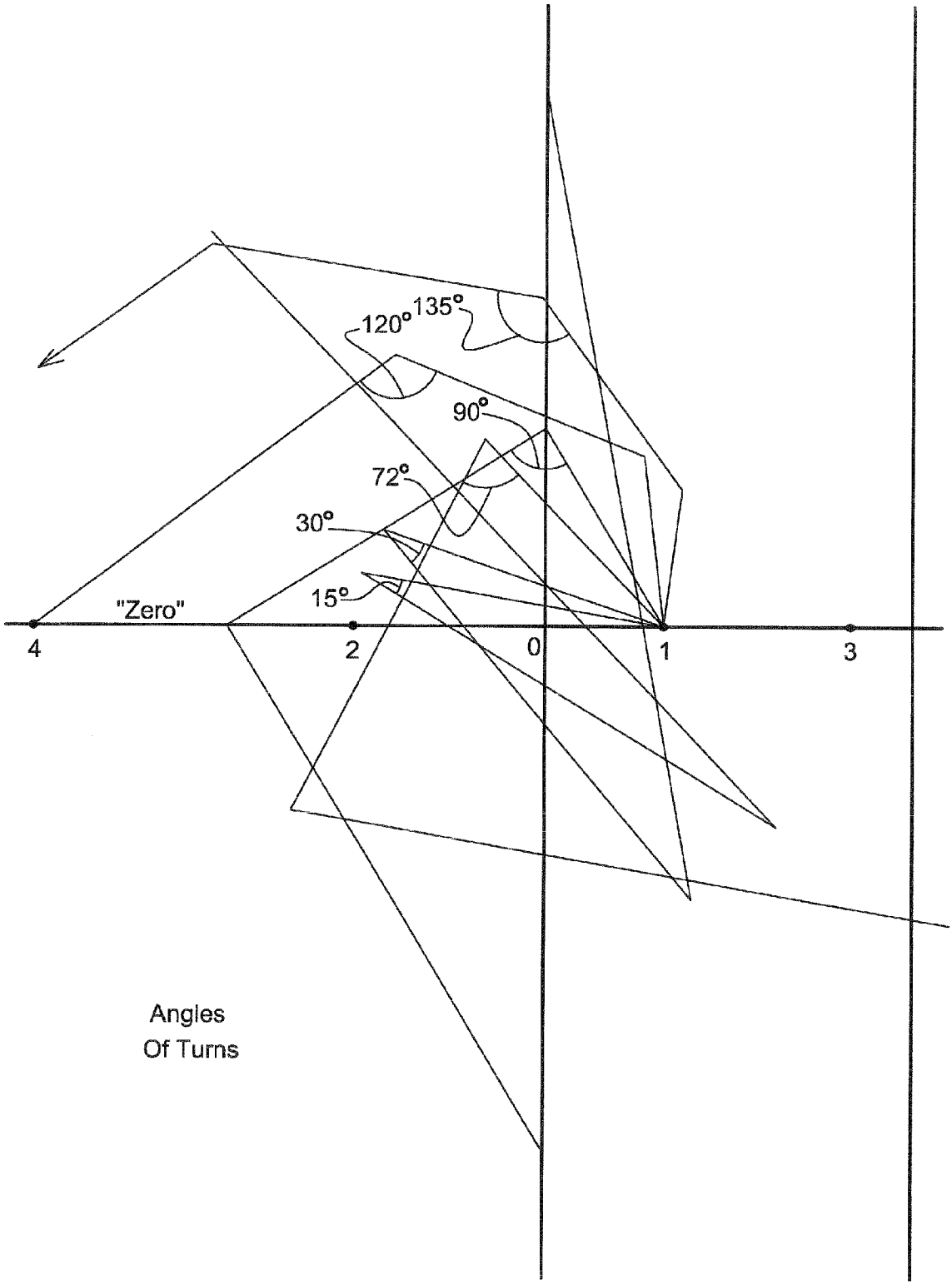
FIG. 10 is a graph showing lines connecting the points of spirals at which the centers of diaphragms can be arranged in accordance with the teachings of the invention.

Referring now to FIG. 10, lines connecting the points on the various spirals at which the centers of diaphragms of the transducers may be arranged in a single loudspeaker system are shown, e.g., the equiangular spiral of FIG. 1 (angle of turn of 90°), the spiral of FIG. 7 (angle of turn of 72°) and the spiral of FIG. 8 (angle of turn of 180°). For purposes of simplicity and clarity, instead of referring to the constant tangent angles of equiangular spirals as in the description of FIGS. 1, 7 and 8 above, reference is made to angles of "turns" utilizing straight line segments as shown in FIG. 10. Also shown in FIG. 10, are turns at angles of 15°, 30°, 120° and 135°. Regardless of the angle of turns, all straight line spiral segments shown are in Golden Proportions to one another.

As previously stated herein, angles of rotation about the pole which are in GS Phi (Φ) ratios and which are greater than 180° and smaller than 360° are clockwise spirals (as opposed to counterclockwise) and the polar equation growth rate constant is negative. This fact makes a tolerance factor for the angles of turns "less than zero degrees" or more than 180° rotations unnecessary. Angles of "turns" which are 180° (which achieve GS Phi, Φratios in 2π radians, or 360° rotations of the pole) lie on an "unfolded" straight line, the pole of which resides outside the four or more points, and therefore is incapable of demonstrating the virtual point source effect.

The largest angle of turns of 120° is not arbitrary as this is the largest angle in which two turns and four points (four-way configuration—assuming the line segments are in sequential Golden Proportions) may enclose the pole of the equiangular spiral, albeit, on a straight line. Angles of turns approaching 135°, however, require three turns and four points (a five-way configuration) in order to enclose the pole within itself.

Figure 11A:
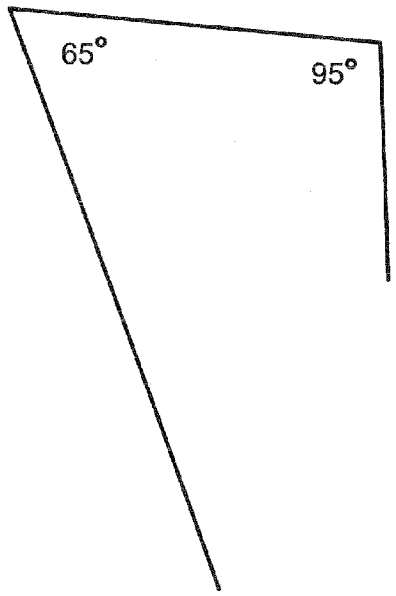
FIGS. 11A and 11B show additional lines with angles connecting points at which the centers of diaphragms can be arranged in accordance with the teachings of the invention.
Figure 11B:
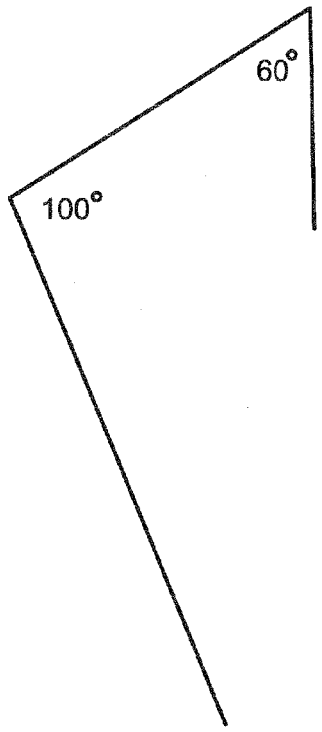

It is also possible to construct a loudspeaker system wherein the required center points of the diaphragms of the transducers are obtained by a combination of angles which are more than the 90° of the equiangular Golden Rectangle spiral and less than the 72° of the Golden Triangle spiral and the distances between the center points and the pole are more or less than Phi (Φ) in ascent, or its reciprocal, 1/Phi (1/Φ) in descent (See FIGS. 11A and 11B for some exemplifying lines connecting center points. Also, the diameters, areas and mass ratios of the diaphragms may be larger and/or smaller than Phi (Φ), Phi squared ($\Phi^2$), and Phi cubed ($\Phi^3$) in ascent, and larger or smaller than their reciprocals, $1/\Phi$, $1/\Phi^2$, and $1/\Phi^3$, in descent, respectively.

Figure 12:
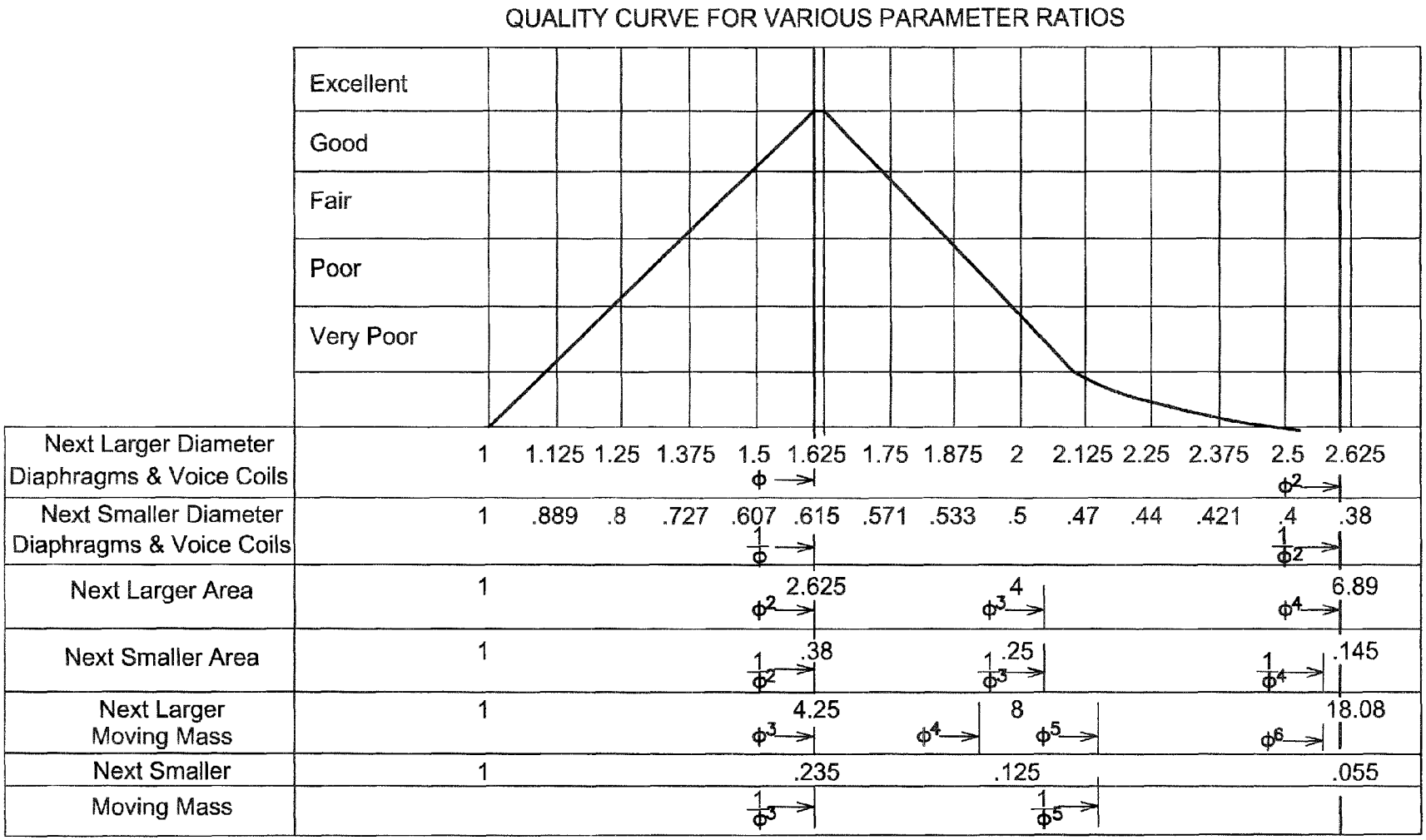
FIG. 12 is a curve showing the quality of various ratios of the diaphragms in accordance with the invention.

FIG. 12 shows a quality curve for various parameter ratios with the expected greatest quality being obtained at ratios related to Phi.

The transducers in any of the embodiments described above can be placed so that their center axes and thus their outputs are perpendicular to a plane defined by the front, outer surface of the transducers in the loudspeaker system. In the alternative, it is possible to place one or more of the transducers at an acute angle to this plane, for example, at an angle of about 30° or more to this plane, i.e., 60° or less to a perpendicular plane.

In the embodiments above wherein a single transducer is positioned with its center point at a point on a spiral, it is possible to use two or more transducers instead of a single transducer and providing the same effect as the single transducer by arranging the two or more transducers to produce a generally "virtual" common focal point. Thus, it is conceivable, for example, that three 8" transducers may be arranged in a tight cluster to create a virtual common focal point at a specified location along the spiral and thus can be used instead of a single 12" transducer.

Figure 13:
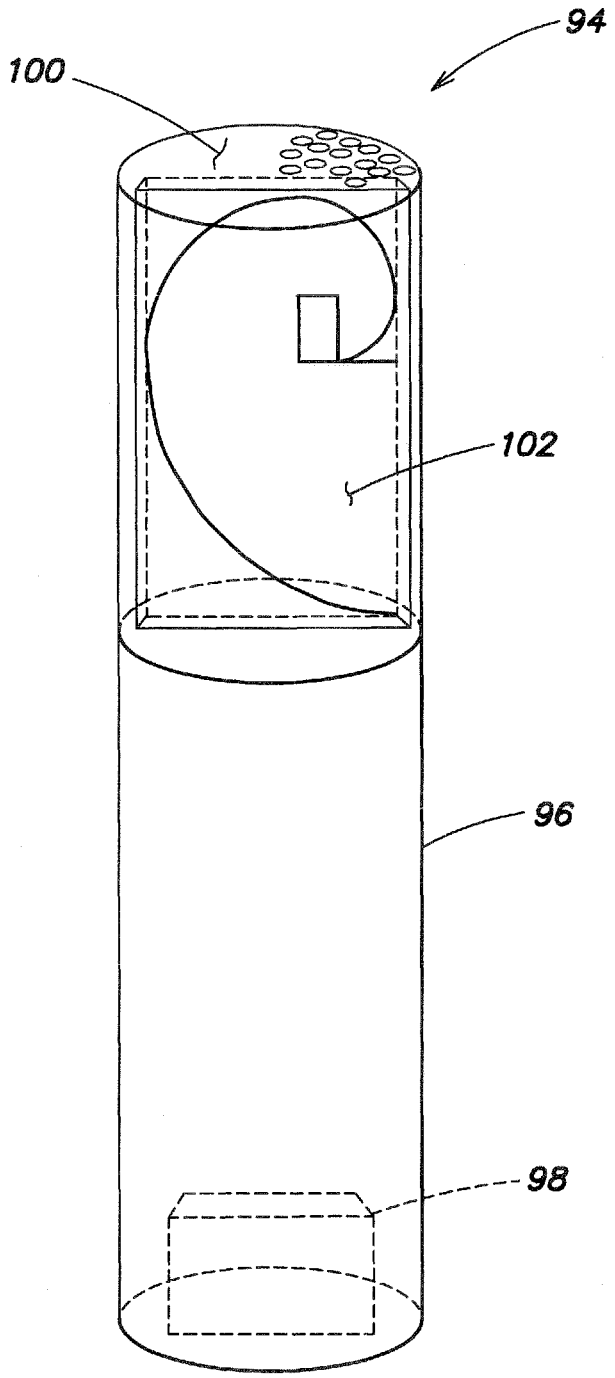
FIG. 13 is a perspective view of a microphone with a diaphragm constructed in accordance with the invention.

Referring now to FIG. 13, a single-element asymmetrical diaphragm condenser and electret condenser microphone will now be described. The microphone 94 includes a support or housing 96 containing a power supply 98, a grille or screen 100 with apertures therein and a diaphragm 102 arranged below the grille 100. The electrical connections from the power supply 98 are not shown. Microphone 94 may include additional structure known to those skilled in the art to enable its operability in its usual and customary manner.

The diaphragm 102 has a unique shape, specifically, it is in the shape of a single, uninterrupted equiangular spiral of approximately 73° constant tangent angle (based on a Golden Rectangle). As noted above, the size and shape of the diaphragm 102 matter significantly in the areas of output, off-axis response, smoothness, high and low frequency extension, and transient response. If, for example, the diaphragm 102 were to be made one half-inch wide (½"), by 0.809 inches (approx. 13/16") long, its area would be at least 162% larger than a one half-inch (½") round diaphragm, and therefore possess higher output, equivalent horizontal response, a wider frequency response, and improved transient response. Most importantly, however, the overall characteristic would be that the diaphragm 102 responds to all frequencies equally, as a continuum (of radiation resistances in reverse), and still exhibits a virtual point source effect. This is so because for a given diaphragm area, this shape will outperform any other shape in the aforementioned criteria. Left and right mirror-imaged pairing is an additional benefit. Although this embodiment is herein described as utilizing the electrostatic/electret condenser driving force, this does not preclude the use of other types of driving forces.

Figure 14A:
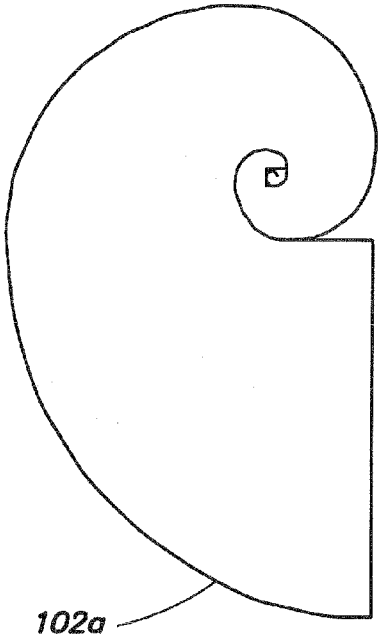
FIGS. 14A, 14B and 14C are enlarged views of alternative diaphragms for the microphone shown in FIG. 13, and the loudspeaker shown in FIG. 15.
Figure 14B:
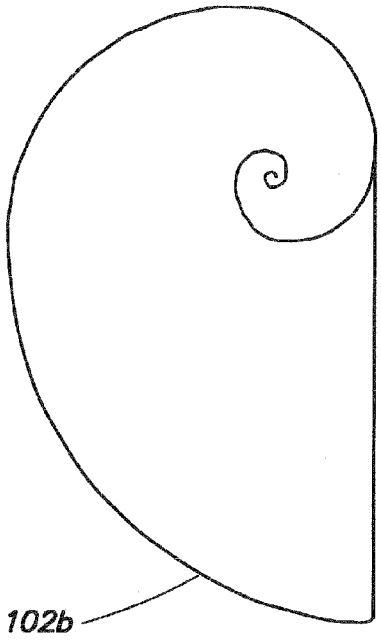
Figure 14C:
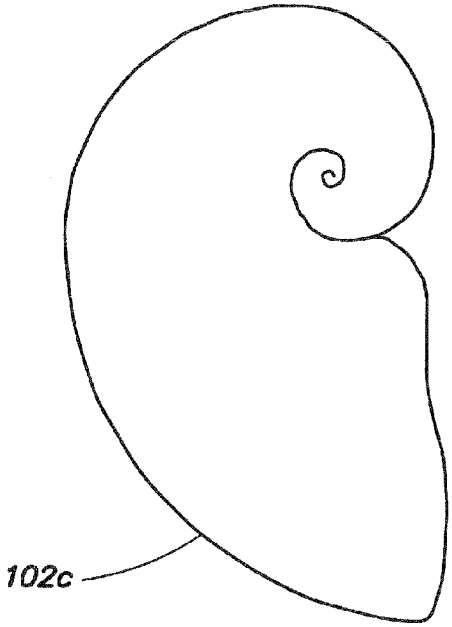

It is possible, and may even be preferable at times, to utilize more rotations of the spiral when forming the diaphragm 102 and if formed based on a shape obtained by drafting the spiral on polar graph paper, thus rendering a true logarithmic spiral which expands continuously throughout its length, instead of the approximations of quarter circles. The termination at the spiral's widest end may result in a diaphragm 102*a*, 102*b* having a straight line (see FIGS. 14A and 11B), or a diaphragm 102*c* having a curve or curved line (see FIG. 140), as is found in nature, or a combination of both, i.e., a straight line and a curved line. Additionally, the termination at or near the pole could end in a curved line (see FIGS. 14A, 14B and 14C).

The microphone 94, including the asymmetrical spiral-shaped diaphragm 102, has a highly optimal shape for reconciling parameters that are generally considered mutually exclusive, i.e., frequency response, polar response, transient response, output and overall neutrality. The spiral shape of the diaphragm 102 will outperform any other shape with the same diaphragm area in all of the aforementioned criteria. Additionally, the spiral-shape of the diaphragm 102 is intrinsically conducive to mirror-imaged left and right channel configurations.

Figure 16:
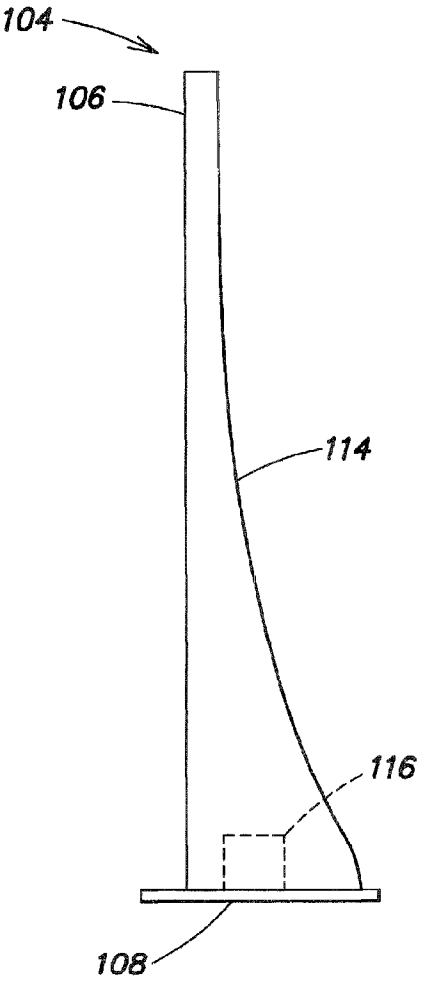
FIG. 16 is a side view of the loudspeaker shown in FIG. 15.
Figure 15:
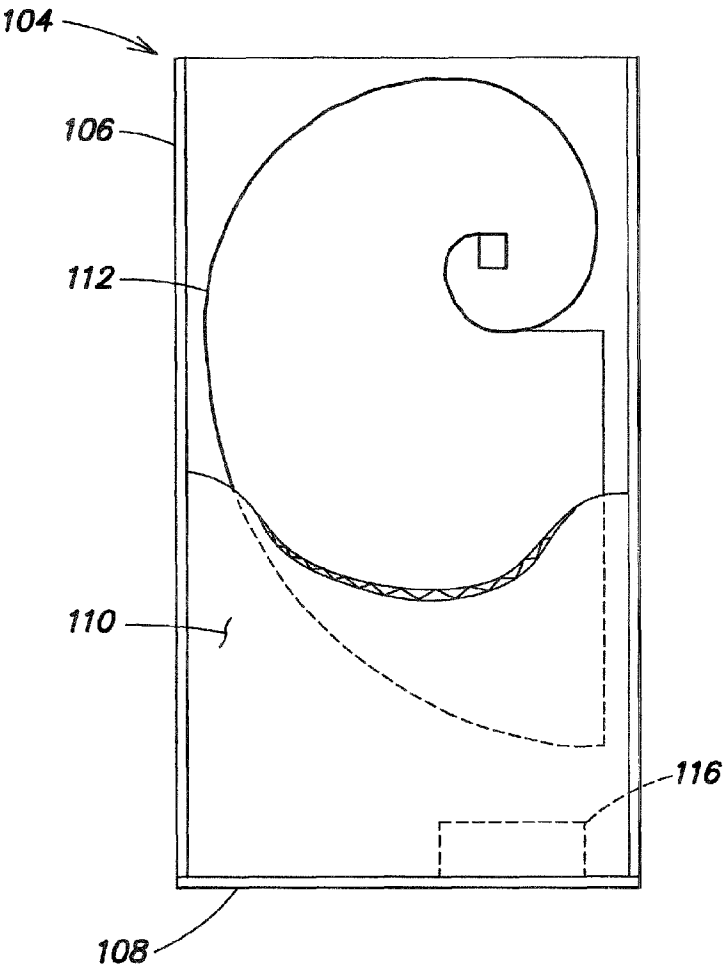
FIG. 15 is a front view of another embodiment of a loudspeaker in accordance with the invention.

In a similar manner as a diaphragm of a microphone can be shaped based on an equiangular spiral, it is also possible to construct an electrostatic loudspeaker with a full-range single diaphragm having a spiral-shape. Referring to FIGS. 15 and 16, a loudspeaker 104 in such an embodiment includes a housing 106 mounted on a base 108, a grille 110 mounted in the housing 106 in front of an electrostatic transducer diaphragm 112. The housing 106 also includes side rails 114 having a curved rear edge and a straight front edge such that the side rails 114 are wider at the base 108 than at the top of the housing 106. A high voltage supply 116 is arranged in the housing 106, e.g., mounted on the base 108. The electrical connections of the power supply 116 are not shown.

Although the electrostatic transducer diaphragm 112 is not mass-controlled, but rather a resistance-controlled device, the overall size and shape of the diaphragm 112 does have an effect on frequency response, off-axis response, efficiency, and imaging capabilities. For a given area of the diaphragm 112, the shape thereof obtained based on an equiangular spiral of about 73° will outperform any other shape in the above-mentioned criteria. In contrast to a typically tall and narrow, symmetrically-shaped diaphragm which behaves as a line source, the asymmetrically shaped diaphragm 112 exhibits the attribute of a virtual point source (along a single axis) while exhibiting a continuum of radiation resistances which are virtually independent of frequency.

Preferably, the diaphragm 112 would be shaped based on a spiral with more rotations which is optimally drafted on polar graph paper or a computer, thus rendering a true logarithmic spiral which is continuously expanding throughout its length. The termination at its widest end may be straight, as shown, curved, as found in nature, or a combination of both. Additionally the termination at or near the pole would be a curved line (see FIGS. 14A, 14B and 14C discussed above).

Although this embodiment is described in connection with a single-diaphragm electrostatic loudspeaker, the use of different driving forces of the diaphragm and its use in multi-way arrays are also envisioned within the scope of the invention.

The loudspeaker 104 with the single spiral-shaped diaphragm 112 exhibits essentially the same advantages of the loudspeaker systems 10, 72 described above and provides a full frequency range electrostatic loudspeaker with the added advantage that the crossover and its attendant detrimental effects are eliminated. Left and right channel mirror-imaged pairs are intrinsic to the design and serves to perfect the stereophonic imaging.

Figure 17A:
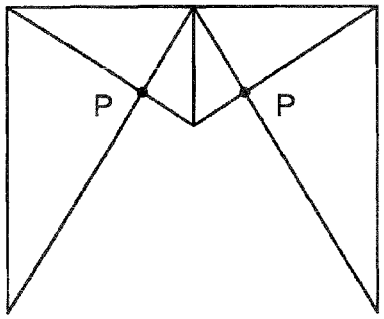
FIGS. 17A, 17B and 17C show symmetrical patterns which may be used to position transducers of a loudspeaker system in accordance with the invention.
Figure 17B:
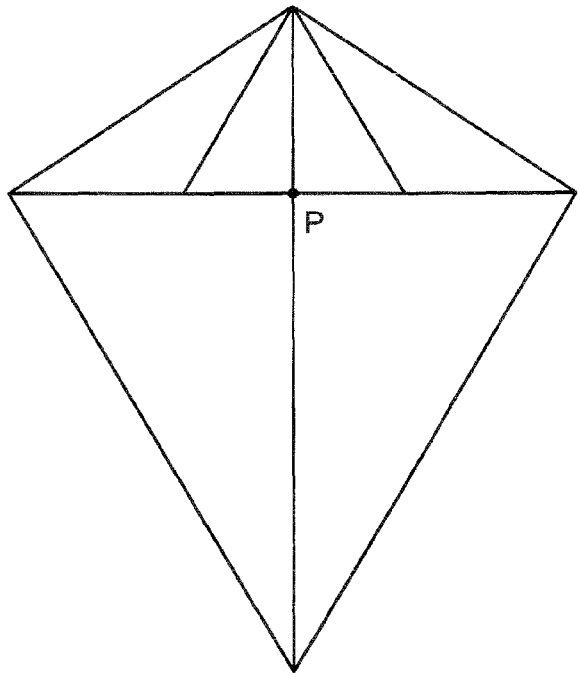
Figure 17C:
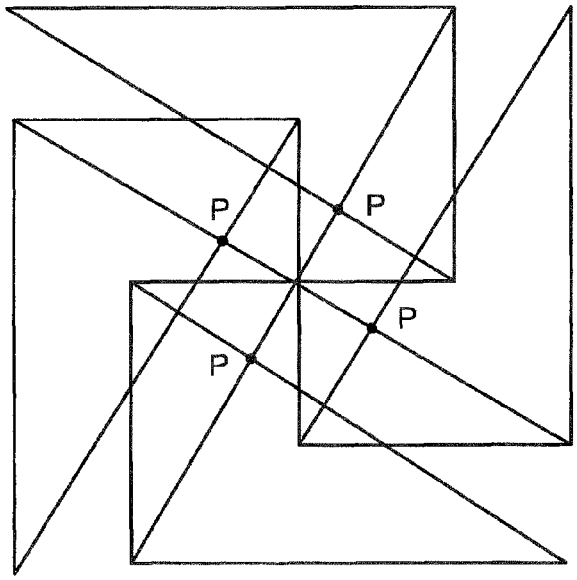

Referring now to FIGS. 17A, 17B and 17C, although the planar geometry of the transducer arrangement is itself asymmetrical, two or more arrays can be combined to form a symmetrical pattern. FIGS. 17A and 17B show the combination of asymmetrical patterns in a reflection manner to form a mirror or bilateral symmetrical arrangement. FIG. 17C shows an asymmetrical pattern rotated to form a radially symmetrical arrangement. The centers of the transducers of a loudspeaker system constructed in this manner could be arranged at the points of the symmetrical pattern thus formed by the combination of two or more asymmetrical patterns.

Characteristic features of the embodiments of the invention described above will now be listed. Each characteristic feature may apply only to certain embodiments and not others.

One characteristic feature is that horizontal and vertical polar patterns of transducers are alternated, and therefore much less prone to interfering with each other as compared to a straight line geometric configuration, resulting in a clearer, more coherent sound reproduction along a single axis (the pole of the spiral). Consequently, the use of multiple crossover points closer together than the three octave "rule" is relaxed. This provides the designer of a loudspeaker system almost total freedom (crossover type notwithstanding) as it is well known in the art that multiple electronic and/or passive crossovers may be combined to this end without undue detriment.

Another feature is that relaxation of the three octave "rule" allows crossovers to be closer together than is recommended (three octaves), thereby allowing them to occur at frequencies where the diaphragm is appreciably smaller than the wavelength. Therefore, the on and off-axis response maintains an essentially flat characteristic rendering a flatter power response.

Another feature is that the two-dimensional (planar) geometry of the four or more non-coincident transducers, proportioned and configured by the design method discussed above (which when coupled to prior art methods of the third dimension (horizontal or front to back) achieves a time alignment), completes a scientific methodology which may be used to achieve an output with the same phase and frequency magnitude as the input (e.g., normal polarity first-order Butterworth crossover), along a clearly defined axis which results in a wide bandwidth, coherent, and unified sound field. This results in what may be called a (three-dimensional) conical spiral.

Yet another characteristic feature of the embodiments wherein a spiral-shaped diaphragm is used is that the diaphragm may be in the shape of an uninterrupted homogeneous equiangular spiral of approximately 73° constant tangent angle designed by the method disclosed herein and therefore, possesses an almost infinite number of contiguous sets of points, each set comprising four or more points. The transducers placed at these points coalesce into a perfectly proportioned uninterrupted (contiguous), full frequency range continuum of radiation resistances along a single axis (the pole of the spiral).

Another characteristic feature is that the inherent asymmetry of the spiral is conducive to mirror-imaged pairing provided by left-handed (counterclockwise), and right-handed (clockwise) spiral configurations for use on the left and right channels, respectively, of a loudspeaker system. This significantly improves the stereophonic imaging. Moreover, as the complexity of the spiral used to position the transducers increases, the coherence and the virtual point source effect increase.

Still another feature is that since the loudspeaker systems and microphones in accordance with the invention have an output (or input in the case of a microphone) along a defined line in space, they have a defined line in space for the purposes of scientific measurements (a line is an infinite series of points). This translates to a preferred axis for listening. By contrast, the vast majority of other configurations (three or more-way in particular) often have no defined location in space for measurements, and therefore, either the individual drivers are measured separately, and the curves are then superimposed, or the measurements are taken at many different points in space, and then averaged. This lack of a precise measuring point or "line" in space in prior art sound systems is one of the main reasons they are less coherent.

Furthermore, although the virtual point source effect in sound systems in accordance with the invention is generally manifested along a single axis (the pole of the spiral), this remains constant through a 360° rotation about this pole. Although the off-axis polar response will undergo variations through this rotation, the on-axis response will not. In this regard, therefore, although the polar response is asymmetrical, the orientation about the pole is not critical, e.g., horizontal versus vertical placement of loudspeaker systems and microphones does not affect the sound quality.

Dependent on size and complexity, an ideal transducer would propagate its power in radiation resistances which are independent of frequency (as a continuum) and simultaneously manifests them along a single axis (as a point source), is realized. This renders a flatter power response.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A loudspeaker system, comprising:

a housing; and at least four transducers arranged in said housing, each of said transducers including a substantially circular diaphragm, a first one of said diaphragms being the smallest diaphragm, a second one of said diaphragms being larger than said first diaphragm, a third one of said diaphragms being larger than said second diaphragm and a fourth one of said diaphragms being larger than said third diaphragm, a ratio of a diameter of each of said diaphragms to a diameter of an immediately larger one of said diaphragms being between 1:1 and 1: $Phi^2$(phi=(1+√5)/2) and a ratio of the diameter of each of said diaphragms to a diameter of an immediately smaller one of said diaphragms being between 1:1 and 1:(1/$Phi^2$), said diaphragms being configured such that centers of said diaphragms lie on a spiral in ascending size order such that a center of said first diaphragm is closest to a pole of said spiral, a center of said second diaphragm is farther than the center of said first diaphragm from the pole, a center of said third diaphragm is farther than the center of said second diaphragm from the pole and a center of said fourth diaphragm is farther than the center of said third diaphragm from the pole, said diaphragms being further configured such that the spiral on which the centers of said diaphragms lie is an equiangular spiral of approximately 73° constant tangent angle derived from a Golden Rectangle and the centers of adjacent one of said diaphragms are separated by 90° angles of rotation from the pole.

2. The loudspeaker system of claim 1, wherein said spiral is a clockwise spiral.

3. The loudspeaker system of claim 1, wherein said spiral is a counterclockwise spiral.

4. A loudspeaker system, comprising:

a housing; and at least four transducers arranged in said housing, each of said transducers including a substantially circular diaphragm, a first one of said diaphragms being the smallest diaphragm, a second one of said diaphragms being larger than said first diaphragm, a third one of said diaphragms being larger than said second diaphragm and a fourth one of said diaphragms being larger than said third diaphragm, a ratio of a diameter of each of said diaphragms to a diameter of an immediately larger one of said diaphragms being between 1:1 and 1: $Phi^2$(Phi=(1+√5)/2) and a ratio of the diameter of each of said diaphragms to a diameter of an immediately smaller one of said diaphragms being between 1:1 and 1:(1/$Phi^2$), said diaphragms being configured such that centers of said diaphragms lie on a spiral in ascending size order such that a center of said first diaphragm is closest to a pole of said spiral, a center of said second diaphragm is farther than the center of said first diaphragm from the pole, a center of said third diaphragm is farther than the center of said second diaphragm from the pole and a center of said fourth diaphragm is farther than the center of said third diaphragm from the pole, said diaphragms being further configured such that the spiral on which the centers of said diaphragms lie is approximately 76° derived from a Golden Triangle having angles of 36° , 72° and 72° and the centers of adjacent one of said diaphragms are separated by 108° angles of rotation from the pole.

5. The loudspeaker system of claim 1, wherein said first diaphragm is a tweeter, said second diaphragm is an upper midrange speaker, said third diaphragm is a lower midrange speaker and said fourth diaphragm is a woofer.

6. The loudspeaker system of claim 1, wherein said transducers are square.

7. A loudspeaker system, comprising:

a housing; and at least four transducers arranged in said housing, each of said transducers including a substantially circular diaphragm, a first one of said diaphragms being the smallest diaphragm, a second one of said diaphragms being larger than said first diaphragm, a third one of said diaphragms being larger than said second diaphragm and a fourth one of said diaphragms being larger than said third diaphragm, a ratio of a diameter of each of said diaphragms to a diameter of an immediately larger one of said diaphragms being between 1:1 and 1: $Phi^2$(Phi =(1+√5)/2) and a ratio of the diameter of each of said diaphragms to a diameter of an immediately smaller one of said diaphragms being between 1:1 and 1:(1/$Phi^2$), said diaphragms being configured such that centers of said diaphragms lie on a spiral in ascending size order such that a center of said first diaphragm is closest to a pole of said spiral, a center of said second diaphragm is farther than the center of said first diaphragm from the pole, a center of said third diaphragm is farther than the center of said second diaphragm from the pole and a center of said fourth diaphragm is farther than the center of said third diaphragm from the pole, said diaphragms being further configured such that the spiral on which the centers of said diaphragms lie is approximately 81° constant tangent angle and the centers of adjacent ones of said diaphragms are separated by 180° angles of rotation from the pole.

8. The loudspeaker system of claim 1, wherein said at least four transducers comprise only four transducers, the centers of said diaphragms being arranged such that an angle of turn between lines connecting each of said centers to the adjacent one of said centers is between 0° and 120°.

9. The loudspeaker system of claim 1, wherein a ratio of the area of each of said diaphragms to the area of an immediately larger one of said diaphragms is between 1:1 and 1:$Phi^4$ and a ratio of the area of each of said diaphragms to the area of an immediately smaller one of said diaphragms is between 1:1 and 1:(1/$Phi^4$).

10. The loudspeaker system of claim 9, wherein said diaphragms are circular and a ratio of a diameter of each of said diaphragms to the diameter of an immediately larger one of said diaphragms is between 1:1 and 1: $Phi^2$(Phi =(1+√5)/2) and a ratio of the diameter of each of said diaphragms to the diameter of an immediately smaller one of said diaphragms between 1:1 and 1:(1/$Phi^2$), the diameter being an actual piston diameter, an effective or emissive diameter or a voice coil diameter.

11. A loudspeaker system, comprising:

a housing; and at least four transducers arranged in said housing, each of said transducers including a substantially circular diaphragm, a first one of said diaphragms being the smallest diaphragm, a second one of said diaphragms being larger than said first diaphragm, a third one of said diaphragms being larger than said second diaphragm and a fourth one of said diaphragms being larger than said third diaphragm, a ratio of a diameter of each of said diaphragms to a diameter of an immediately larger one of said diaphragms being between 1:1 and 1: $Phi^2$(Phi=(1+√5)/2) and a ratio of the diameter of each of said diaphragms to a diameter of an immediately smaller one of said diaphragms being between 1:1 and 1:(1/$Phi^2$), said diaphragms being configured such that centers of said diaphragms lie on a spiral in ascending size order such that a center of said first diaphragm is closest to a pole of said spiral, a center of said second diaphragm is farther than the center of said first diaphragm from the pole, a center of said third diaphragm is farther than the center of said second diaphragm from the pole and a center of said fourth diaphragm is farther than the center of said third diaphragm from the pole, wherein a ratio of a line segment or distance between the pole and the center of each of said diaphragms to the line segment or distance between the pole and the center of an immediately larger one of said diaphragms is between 1:1 and 1: $Phi^2$and a ratio of the line segment or distance between the pole and the center of each of said diaphragms to the line segment or distance between the pole and the center of an immediately smaller one of said diaphragms between 1:1 and 1:(1/$Phi^2$).

12. A loudspeaker system, comprising:

a housing; and at least four transducers arranged in said housing, each of said transducers including a substantially circular diaphragm, a first one of said diaphragms being the smallest diaphragm, a second one of said diaphragms being larger than said first diaphragm, a third one of said diaphragms being larger than said second diaphragm and a fourth one of said diaphragms being larger than said third diaphragm, a ratio of a diameter of each of said diaphragms to a diameter of an immediately larger one of said diaphragms being between 1:1 and 1: $Phi^2$($Phi=(1+\sqrt{5})/2$) and a ratio of the diameter of each of said diaphragms to a diameter of an immediately smaller one of said diaphragms being between 1:1 and 1:($1/Phi^2$), said diaphragms being configured such that centers of said diaphragms lie on a spiral in ascending size order such that a center of said first diaphragm is closest to a pole of said spiral, a center of said second diaphragm is farther than the center of said first diaphragm from the pole, a center of said third diaphragm is farther than the center of said second diaphragm from the pole and a center of said fourth diaphragm is farther than the center of said third diaphragm from the pole, wherein said diaphragms are mass-controlled and include a moving mass, a ratio of the moving mass of each of said diaphragms to the moving mass of an immediately larger one of said diaphragms is between 1:1 and 1: $Phi^6$ and a ratio of the moving mass of each of said diaphragms to the moving mass of an immediately smaller one of said diaphragms between 1:1 and 1:($1/Phi^6$).

13. The loudspeaker system of claim 4, wherein said spiral is a clockwise spiral.

14. The loudspeaker system of claim 4, wherein said spiral is a counterclockwise spiral.

15. The loudspeaker system of claim 4, wherein said first diaphragm is a tweeter, said second diaphragm is an upper midrange speaker, said third diaphragm is a lower midrange speaker and said fourth diaphragm is a woofer.

16. The loudspeaker system of claim 4, wherein said transducers are square.

17. The loudspeaker system of claim 4, wherein a ratio of the area of each of said diaphragms to the area of an immediately larger one of said diaphragms is between 1:1 and 1:$Phi^4$ and a ratio of the area of each of said diaphragms to the area of an immediately smaller one of said diaphragms is between 1:1 and 1:($1/Phi^4$).

18. The loudspeaker system of claim 4, wherein the spiral on which the centers of said diaphragms lie is 75.6788°.

* * * * *

UNITED STATES PATENT AND TRADEMARK OFFICE

CERTIFICATE OF CORRECTION

PATENT NO. : 8,422,721 B2
APPLICATION NO. : 12/881398
DATED : April 16, 2013
INVENTOR(S) : Frank Rizzello It is certified that error appears in the above-identified patent and that said Letters Patent is hereby corrected as shown below:

On the Title page; Item [57] Abstract, line 8:

replace "diaphragm," with --diaphragm--.

Title page Item [57] Abstract, line 9:

delete "Phi)" and insert --$Phi^2$)--.

In the Specifications:

Column 10, line 38:

delete ") (90°" and insert --(90°)--.

Column 10, line 58:

delete ") (90°" and insert --(90°)--.

Column 14, line 35:

delete ") (73°" and insert --(73°)--.

Column 15, line 37-38:

delete "73°) (72.9676°" and insert --73° (72.9676°)--.

Column 16, line 14:

delete ") (72°" and insert --(72°)--.

Column 16, line 34:

delete "81°) (81.29143573°" and insert --81° (81.29143573°)--.

Column 16, line 36:

delete "n" and insert --π--.

Column 18, line 26:

delete "1:Phi'" and insert --$1:Phi^4$--.

Signed and Sealed this
Third Day of September, 2013

Teresa Stanek Rea
*Acting Director of the United States Patent and Trademark Office*

Column 20, line 9:

delete “140),” and insert --14C),--.

In the Claims:

Column 24, line 58, claim 11:

delete “1:Phi$^2$and” and insert --1:Phi$^2$ and--.